US006720042B2

(12) United States Patent
Ylitalo et al.

(10) Patent No.: US 6,720,042 B2
(45) Date of Patent: Apr. 13, 2004

(54) PRIMED SUBSTRATES COMPRISING RADIATION CURED INK JETTED IMAGES

(75) Inventors: Caroline M. Ylitalo, Stillwater, MN (US); Jennifer L. Lee, Eagan, MN (US); Richard L. Severance, Stillwater, MN (US); Oh Sang Woo, Woodbury, MN (US); Eugene P. Janulis, Mahtomedi, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 09/837,305

(22) Filed: Apr. 18, 2001

(65) Prior Publication Data

US 2003/0021961 A1 Jan. 30, 2003

(51) Int. Cl.[7] ..... B41M 5/00
(52) U.S. Cl. ..... 428/32.26; 428/32.1; 428/32.34
(58) Field of Search ..... 428/195, 323, 428/480, 500, 354, 42.1, 32.1, 32.26, 32.34

(56) References Cited

U.S. PATENT DOCUMENTS

| | | | | |
|---|---|---|---|---|
| 5,102,737 | A | 4/1992 | Josephy et al. | 428/411.1 |
| 5,270,368 | A | 12/1993 | Lent et al. | 524/236 |
| 5,424,355 | A | 6/1995 | Uemae et al. | |
| 5,478,631 | A * | 12/1995 | Kawano et al. | 428/212 |
| 5,610,215 | A | 3/1997 | Nonweiler et al. | |
| 5,645,899 | A | 7/1997 | Unterberger | 427/558 |
| 5,804,301 | A | 9/1998 | Curatolo | 428/352 |
| 5,837,351 | A | 11/1998 | Chernovitz et al. | 428/195 |
| 5,908,495 | A * | 6/1999 | Nohr et al. | 106/31.32 |
| 5,958,169 | A | 9/1999 | Titterington et al. | |
| 5,981,113 | A | 11/1999 | Christian | 430/9 |
| 5,989,771 | A | 11/1999 | Ohta et al. | |
| 5,998,534 | A | 12/1999 | Tang et al. | 524/548 |
| 6,054,208 | A | 4/2000 | Rega et al. | 428/323 |
| 6,114,406 | A | 9/2000 | Caiger et al. | 522/121 |
| 6,130,308 | A | 10/2000 | Rink et al. | |
| 6,180,228 | B1 * | 1/2001 | Mueller et al. | 428/354 |

FOREIGN PATENT DOCUMENTS

| | | |
|---|---|---|
| DE | 10051088 | 4/2002 |
| EP | 0 952 005 | 10/1999 |
| GB | 2 338 212 | 12/1999 |
| WO | WO 97/47480 | 12/1997 |
| WO | WO 98/04418 | 2/1998 |
| WO | WO 99/06489 | 2/1999 |
| WO | WO 99/29788 | 6/1999 |
| WO | WO 99/64249 | 12/1999 |
| WO | WO 00/01536 | 1/2000 |
| WO | WO 00/41890 | 7/2000 |
| WO | WO 00/52532 | 9/2000 |
| WO | WO 02/31016 | 4/2002 |
| WO | WO 02/062894 | 8/2002 |

OTHER PUBLICATIONS

"Practical Consideration for Using UV Reactive Inks in Piezo DOD Printheads", 1999 International Conference on Digital Pringing Techniques, Richard J. Baker, 5 pages.

* cited by examiner

*Primary Examiner*—Cynthia H. Kelly
*Assistant Examiner*—B. Shewareged
(74) *Attorney, Agent, or Firm*—Carolyn A. Fischer

(57) ABSTRACT

The present invention relates to primed substrates comprising radiation cured ink jetted images and methods of ink jet printing radiation curable inks that employ applying a primer. The imaged articles are durable for outdoor usage. A variety of polymeric sheets may be primed including various sheeting for signage and commercial graphic films for advertising and promotional displays.

23 Claims, No Drawings

PRIMED SUBSTRATES COMPRISING RADIATION CURED INK JETTED IMAGES

FIELD OF THE INVENTION

The present invention relates to primed substrates comprising radiation cured ink jetted images and methods of ink jet printing radiation curable inks that employ applying a primer. The imaged articles are durable for outdoor usage. A variety of polymeric sheets may be primed including various sheeting for signage and commercial graphic films for advertising and promotional displays.

BACKGROUND OF INVENTION

A variety of print methods have been employed for imaging various sheet materials. Commonly employed print methods include gravure, off-set, flexographic, lithographic, electrographic, electrophotographic (including laser printing and xerography), ion deposition (also referred to as electron beam imaging [EBI]), magnetographics, ink jet printing, screen printing and thermal mass transfer. More detailed information concerning such methods is available in standard printing textbooks.

One of ordinary skill in the art appreciates the differences in these various print methods and recognizes that a combination of ink and receiving substrate that results in high image quality in one printing method often exhibits an entirely different image quality with another print method. For example, in contact printing methods such as screen printing, a blade forces the ink to advance and wet the receiving substrate. Image defects are typically due to a subsequent recession of the ink contact angle with the substrate. In the case of non-contact printing methods such as ink jet printing, the individual ink drops are merely deposited on the surface. In order to achieve good image quality, the ink drops need to spread, join together, and form a substantially uniform, leveled film. This process requires a low advancing contact angle between the ink and the substrate. For any given ink/substrate combination, the advancing contact angle is typically significantly greater than the receding contact angle. Accordingly, ink/substrate combinations that result in good image quality when printed with contact methods such as screen printing, often exhibit insufficient wetting when imaged with non-contact printing methods such as ink jet printing. Insufficient wetting results in low radial diffusion of the individual ink drops on the surface of the substrate (also referred to as "dot gain"), low color density, and banding effects (e.g. gaps between rows of drops).

Another important difference between screen printing and ink jet printing is the physical properties of the ink. Screen printing ink compositions typically contain over 40% solids and have a viscosity of at least two orders of magnitude greater than the viscosity of ink jet printing inks. It is not generally feasible to dilute a screen printing ink to make it suitable for ink jet printing. The addition of large amounts of low viscosity diluents drastically deteriorates the ink performance and properties, particularly the durability. Further, the polymers employed in screen printing inks are typically high in molecular weight and exhibit significant elasticity. In contrast, ink jet ink compositions are typically Newtonian.

Ink jet printing is emerging as the digital printing method of choice due to its good resolution, flexibility, high speed, and affordability. Ink jet printers operate by ejecting, onto a receiving substrate, controlled patterns of closely spaced ink droplets. By selectively regulating the pattern of ink droplets, ink jet printers can produce a wide variety of printed features, including text, graphics, holograms, and the like. The inks most commonly used in ink jet printers are water-based or solvent-based. Water-based inks require porous substrates or substrates with special coatings that absorb water.

On the other hand, solvent-based inks typically contain about 90% organic solvents. Since manufacturers prefer to reduce solvent emissions, the evaporation of large quantities of solvent during ink drying is undesirable. Further, the drying process can be the rate-limiting step for ink jet printing, reducing production rates. In order to avoid the problems associated with water-based and solvent-based inks, radiation-curable ink compositions comprising polymerizable ingredients have been developed. The polymerizable ingredients not only function as a solvent by reducing the viscosity of the composition prior to curing, but also function as a binder when cured, and optionally as a crosslinking agent. In the uncured state, these compositions have low viscosities and are readily ink jettable. The polymerizable ingredients readily react upon exposure to a suitable radiation source (e.g. ultraviolet light, electron beam) to form a crosslinked polymer network. The use of radiation curing allows the inks to "dry instantly" per se in view of the rapidity in which the composition can be radiation cured.

One problem, however, with radiation curable ink jet inks is that ink compositions do not uniformly adhere to all substrates. Accordingly, the ink composition is typically modified for optimized adhesion on the substrate of interest. Further, good wetting and flow onto various substrates is controlled by the ink/substrate interaction. Preferably, the interaction results in a sufficiently low advancing contact angle of the ink on the substrate, as previously described. Accordingly, for the same ink composition, the image quality (e.g. color density and dot gain) tends to vary depending on the substrate being printed. Substrate treatments such as solvent wiping, blowing, corona, flame and UV pretreatment have been suggested in "Practical Considerations for Using UV Reactive Inks in Piezo DOD Print", IS&T NIP 15: 1999 International Conference on Digital Printing Technologies. Further, in the case of ink jet printing onto polymeric materials, WO 99/29788 describes pretreatment by flame, plasma etch or corona treatment to raise the surface energy. As a practical matter, however, many ink jet printing operations are not equipped to pre-treat substrates prior to imaging in this manner. Hence, industry would find advantage in substrates and methods of ink jet printing that address this problem.

SUMMARY OF THE INVENTION

The present invention relates to an article comprising a sheet or polymeric material having a primed surface portion and a radiation cured ink jetted image disposed on said primed surface portion. The substrate, primer and ink are chosen such that the article is durable for outdoor usage. The polymeric material is thermoplastic or thermosetting. Preferred polymeric sheet materials include acrylic-containing films, poly(vinyl chloride)-containing films, poly(vinyl fluoride)-containing films, urethane-containing films, melamine-containing films, polyvinyl butyral-containing films, polyolefin-containing films, polyester-containing films and polycarbonate-containing films. A preferred sheet comprises a retroreflective viewing surface.

The image exhibits an improvement in overall print quality in comparison to the same imaged sheet lacking such primer. The ink and primer exhibit at least about 80% adhesion according to ASTM D 3359-95A. The image preferably has a black color density of at least about 1.5 and a final ink dot size of at least $[(2)^{1/2}]$/dpi wherein dpi is the print resolution is dots per linear inch.

In one embodiment, the primed surface portion comprises at least one film-forming resin comprising an acrylic resin, a polyvinyl resin, a polyester, a polyacrylate, a polyurethane and mixtures thereof. Acrylic resins, polyurethane resins and mixtures thereof are preferred.

In another embodiment, the primed surface portion comprises crosslinked poly(meth)acrylate.

In another embodiment, the primed surface portion comprises at least one colorant.

The article is useful as an intermediate or as a finished product for signage and commercial graphic films.

In other embodiments, the present invention relates to methods of ink jet printing that employ the use of a primer.

In one embodiment, the method comprises applying at least one of a water-based primer composition or a solvent-based primer composition to at least a portion of a sheet or polymeric substrate; allowing the water or solvent to evaporate forming a primed surface; ink jet printing a radiation curable ink composition on said primed surface; and curing said ink forming an imaged article. The primer composition is preferably an acrylic resin, a polyurethane resin, or mixture thereof.

In another embodiment, the method comprises applying a radiation curable primer composition to at least a portion of a sheet or polymeric substrate forming a primed surface; ink jet printing a radiation curable ink composition on said primed surface; and curing said ink forming an imaged article. The method may further comprise curing the primer prior to ink jet printing. The primer composition preferably comprises at least one radiation curable polymer, oligomer, macromonomer, monomer, or mixture thereof.

Regardless of the method, the article is durable for outdoor usage. The ink composition comprises at least one radiation curable polymer, oligomer, macromonomer, monomer, or mixture thereof. The ink has a viscosity from about 3 centipoise to about 30 centipoise at the print head temperature. The ink comprises a liquid component that diffuses into the primed surface. The primer composition is either reactive or unreactive with the ink. The entire surface of the substrate may be primed or only a portion. Preferably, the primed surface corresponds substantially identically in size and shape to the image.

A preferred ink comprises an oligo/resin component and a reactive diluent comprising 0.1 to 50 weight percent of an adhesion promoting radiation curable component comprising a low Tg heterocyclic monomer and/or a monomer comprising pendant alkoxylated functionality, with the proviso that less than about 10 weight percent of the reactive diluent comprises a monomer comprising main-chain alkoxylated functionality. The ink may further comprises at least one of a high Tg component, a multifunctional monomer, a low surface tension component, a gloss component, and mixtures thereof. The ink is preferably substantially free of solvent.

DETAILED DESCRIPTION OF THE INVENTION

The present invention relates to an article comprising a radiation cured ink jetted image. As used herein "ink jetted image" and "ink jet printed" both refer to an image created with an ink jet printing process employing a radiation curable ink composition. The image may be text, graphics, coding (e.g. bar coding), etc., being comprised of a single color, multi-colored or being unapparent in the visible light spectrum.

The article comprises a substrate wherein at least a portion of the surface comprises a primer composition forming a primed surface portion. For ease in manufacturing the entire surface of the substrate may comprise the primer composition. A radiation curable ink is ink jetted or ink jet printed onto the primed surface and cured forming a radiation cured ink jetted image. In the simplest construction, the primer is disposed directly onto the substrate. In other embodiments, wherein additional coatings are employed, the ink jet printed primer is disposed between the substrate and the viewing surface of the article. For example, the article may comprise an additional topcoat or topfilm disposed over the imaged primer layer. Alternatively, the primer may be applied to the topfilm. The primed portion may then be reverse imaged and bonded to a second substrate. In preferred embodiments the primer, ink composition, as well as the entire article, exhibit good weatherability, being durable for outdoor usage. Preferably, the ink and primer composition are sufficiently durable such that additional protective layers are not required.

"Durable for outdoor usage" refers to the ability of the article to withstand temperature extremes, exposure to moisture ranging from dew to rainstorms, and colorfast stability under sunlight's ultraviolet radiation. The threshold of durability is dependent upon the conditions to which the article is likely to be exposed and thus can vary. At minimum, however, the articles of the present invention do not delaminate or deteriorate when submersed in ambient temperature (25° C.) water for 24 hours, nor when exposed to temperatures (wet or dry) ranging from about −40° C. to about 140° F. (60° C.).

In the case of signage for traffic control, the articles are preferably sufficiently durable such that the articles are able to withstand at least one year and more preferably at least three years of weathering. This can be determined with ASTM D4956-99 Standard Specification of Retroreflective Sheeting for Traffic Control that describes the application-dependent minimum performance requirements, both initially and following accelerated outdoor weathering, of several types of retroreflective sheeting. Initially, the reflective substrate meets or exceeds the minimum coefficient of retroreflection. For Type I white sheetings ("engineering grade"), the minimum coefficient of retroreflection is 70 cd/fc/ft$^2$ at an observation angle of 0.2° and an entrance angle of −4°, whereas for Type III white sheetings ("high intensity") the minimum coefficient of retroreflection is 250 cd/fc/ft$^2$ at an observation angle of 0.2° and an entrance angle of −4°. In addition, minimum specifications for shrinkage, flexibility adhesion, impact resistance and gloss are preferably met. After accelerated outdoor weathering for 12, 24, or 36 months, depending on the sheeting type and application, the retroreflective sheeting preferably shows now appreciable cracking, scaling, pitting, blistering, edge lifting or curling, or more than 0.8 millimeters shrinkage or expansion following the specified testing period. In addition, the weathered retroreflective articles preferably exhibit at least the minimum coefficient of retroreflection and colorfastness. For example, Type I "engineering grade" retroreflective sheeting intended for permanent signing applications retains at least 50% of the initial minimum coefficient of retroreflection after 24 months of outdoor weathering and Type III high intensity type retroreflective sheeting intended for permanent signing applications retains at least 80% of the initial minimum coefficient of retroreflection following 36 months of outdoor weathering in order to meet the specification. The coefficient of retroreflection values, both initially and following outdoor weathering, are typically about 50% lower in view of the presence of the radiation cured ink jetted image on the retroreflective substrates.

The article or substrate (e.g. film, sheet) has two major surfaces. The first surface, denoted herein as the "viewing surface" comprises the primer and the radiation cured ink jetted image. The opposing surface of the article may also comprise a printed image forming a "second viewing surface". In such embodiments, the second viewing surface may also comprise a primer composition and radiation cured ink jetted image. Alternatively, and most common however, the opposing surface is a non-viewing surface that typically comprises a pressure sensitive adhesive protected by a release liner. The release liner is subsequently removed and the imaged substrate (e.g. sheeting, film) is adhered to a target surface such as a sign backing, billboard, automobile, truck, airplane, building, awning, window, floor, etc.

The selection of primer is based on the intended ink composition as well as the intended substrate. The primer alters the surface properties of the substrate such that ink/substrate surface interaction is consistent, resulting in good image quality. The primer is chosen such that the main liquid component of the intended ink composition (e.g. the UV curable monomers) exhibits measurable diffusion into the primer layer. For dry and/or cured primer compositions, this can be qualitatively determined by printing a solid block of the desired radiation curable inkjet ink onto a 5 micron thick primer layer at 200% coverage, followed by holding the printed article in a vertical position for 5 minutes. If the ink monomers do not exhibit measurable diffusion into the primer layer, then the printed (uncured) ink will run down the film past the solid block borders. On the other hand, if the ink monomers diffuse too quickly into the primer, then the ink will dissolve the primer and "sagging" of the ink layer when held in the vertical position is observed.

Very slow or non-measurable diffusion results in poor ink/primer interaction leading to poor ink adhesion with the primer. On the other hand, fast diffusion results in poor dot gain and reduced color density since quick lateral diffusion limits the ability of the ink drops to diffuse in the radial direction, causing low dot gain. Typically, if an ink does not interact with the substrate in view of the monomer diffusion on the unprimed substrate being too low, a primer is chosen to which the ink diffuses to a greater extent, thus improving the ink adhesion. On the other hand, if the ink/substrate interaction is such that the monomer diffusion is too high on the unprimed substrate, the presence of the primer reduces the rate of lateral diffusion, improving the color density. Typically, the image quality is optimized by selecting the appropriate thickness of the primer such that the ink drops exhibit limited lateral diffusion, resulting in significant radial diffusion and acceptable dot gain. An increase of primer thickness is typically employed to improve adhesion, whereas a decrease in primer thickness is employed to reduce lateral diffusion.

To achieve good image quality, the printed ink drops must spread to within an acceptable range in order to provide complete solid fill. If the ink drops do not spread enough, unfilled background areas will contribute to reduced color density and banding defects (i.e. gaps between the rows of ink drops). On the other hand, if the ink drops spread too much, loss of resolution and poor edge acuity is evident, and inter-color bleed occurs in the case of multi-color graphics. The image quality can be quantitatively expressed with reference to color density and with regard to the final ink dot diameter, as described in U.S. Pat. No. 4,914,451. The black color density is preferably at least about 1.5. The final ink dot diameter on the substrate is preferably greater than $[(2)^{1/2}]$/dpi but no more than 2/dpi, wherein dpi is the print resolution is dots per linear inch.

The primer composition is suitable for use on a wide variety of substrates. Although the primer composition could be applied to substrates such as paper, upon exposure to rain, paper typically deteriorates and thus is not sufficiently durable for outdoor usage. Similarly, the primer composition could also be applied to a substrate or substrate layer having a low softening point, for example less than about 100° F. (38° C.). However, this construction would also exhibit poor durability. Accordingly, the substrate typically has a softening point greater than about 120° F. (49° C.), preferably greater than about 140° F. (60° C.), more preferably greater than about 160° F. (71° C.), even more preferably greater than about 180° F. (82° C.), and most preferably greater than about 200° F. (93° C.). Other materials that are typically unsuitable for use as the substrate include materials that corrode (e.g. oxidize) or dissolve in the presence of water such as various metals, metallic oxides, and salts.

Suitable materials for use as the substrate in the article of the invention include various sheets, preferably comprised of thermoplastic or thermosetting polymeric materials, such as films. Further, the primer is particularly advantageous for low surface energy substrates. "Low surface energy" refers to materials having a surface tension of less than about 50 dynes/cm (also equivalent to 50 milliNewtons/meter). The polymeric substrates are typically nonporous. However, microporous, apertured, as well as materials further comprising water-absorbing particles such as silica and/or superabsorbent polymers, may also be employed provided the substrate does not deteriorate or delaminate upon expose to water and temperature extremes, as previously described. Other suitable substrates include woven and nonwoven fabrics, particularly those comprised of synthetic fibers such as polyester, nylon, and polyolefins.

The substrates as well as the imaged article (e.g. sheets, films, polymeric materials) for use in the invention may be clear, translucent, or opaque. Further, the substrate and imaged article may be colorless, comprise a solid color or comprise a pattern of colors. Additionally, the substrate and imaged articles (e.g. films) may be transmissive, reflective, or retroreflective.

Representative examples of polymeric materials (e.g. sheet, films) for use as the substrate in the invention include single and multi-layer constructions of acrylic-containing films (e.g. poly(methyl) methacrylate [PMMA]), poly(vinyl chloride)-containing films, (e.g., vinyl, polymeric materialized vinyl, reinforced vinyl, vinyl/acrylic blends), poly(vinyl fluoride) containing films, urethane-containing films, melamine-containing films, polyvinyl butyral-containing films, polyolefin-containing films, polyester-containing films (e.g. polyethylene terephthalate) and polycarbonate-containing films. Further, the substrate may comprise copolymers of such polymeric species. Other particular films for use as the substrate in the invention include multi-layered films having an image reception layer comprising an acid- or acid/acrylate modified ethylene vinyl acetate resin, as disclosed in U.S. Pat. No. 5,721,086 (Emslander et al.). The image reception layer comprises a polymer comprising at least two monoethylenically unsaturated monomeric units, wherein one monomeric unit comprises a substituted alkene where each branch comprises from 0 to about 8 carbon atoms and wherein one other monomeric unit comprises a (meth)acrylic acid ester of a nontertiary alkyl alcohol in which the alkyl group contains from 1 to about 12 carbon atoms and can include heteroatoms in the alkyl chain and in which the alcohol can be linear, branched, or cyclic in nature. A preferred film for increased tear resistance includes multi-layer polyester/copolyester films such as those described in U.S. Pat. Nos. 5,591,530 and 5,422,189.

Depending of the choice of polymeric material and thickness of the substrate, the substrate (e.g. sheets, films) may be rigid or flexible.

Commercially available films include a multitude of films typically used for signage and commercial graphic uses such as available from Minnesota Mining and Manufacturing Company ("3M") under the trade designations "Panaflex", "Nomad", "Scotchcal", "Scotchlite", "Controltac", and "Controltac Plus".

The thickness of the dried and/or cured primer coating typically ranges from about 0.10 microns to about 50 microns. The primer is present in an amount such that it provides the desired ink/substrate interaction, as previously described. The thickness of the primer is preferably at least about 0.50 microns and more preferably at least about 1 micron. Conversely, it is typically desirable to employ as little primer as needed, the thickness preferably being less than about 25 microns, more preferably less than about 10 microns, and most preferably less than about 5 microns. At too high of a primer thickness, the ink may "over wet" rather than "under wet" the substrate surface. This behavior is evident from the overall print quality changing from insufficient dot gain, in the case of an unprimed substrate, to slight mottling of the ink after priming of the same substrate. Alternatively, at too low of a primer thickness, the ink may exhibit insufficient adhesion to the primed surface.

The primer exhibits good adhesion to cured radiation curable ink jet compositions such that the primer exhibits at least 50% adhesion and preferably at least 80% adhesion as measured according to ASTM D 3359-95A. Any composition that contributes the desired ink adhesion and image quality may be employed for use as the primer composition. Preferred primer compositions also exhibit sufficient adhesion to the substrate. The primer adhesion to the substrate can be evaluated in the same manner. However, in the case of poor primer adhesion to the substrate, both the ink and primer are removed from the substrate, rather than merely the ink. For embodiments wherein the primer composition exhibits good ink adhesion in combination with good substrate adhesion, additional bonding layers (e.g. tie layers, adhesive layers) are not required.

Preferred primer and ink compositions are preferably at least as flexible as the substrate. "Flexible" refers to the physical property wherein imaged primer layer having a thickness of 50 microns can be creased at 25° C. without any visible cracks in the imaged primer layer.

The primer composition as well as the ink composition (with the exception of ink compositions containing opaque colorants such as carbon black, titanium dioxide, or organic black dye) are typically transparent when measured according to ASTM 810 Standard Test Method for Coefficient of Retroreflection of Retroreflective Sheeting. That is, when coated onto retroreflective substrates, the visible light striking the surface of such films is transmitted through to the retroreflective sheeting components. This property makes the articles particularly useful for outdoor signing applications, in particular traffic control signing systems. Further, the dried and/or cured primer composition is substantially non-tacky such that the printed image is resistant to dirt build-up and the like.

In general, for enhanced durability for outdoor usage, both the primer compositions and ink compositions are preferably aliphatic, being substantially free of aromatic ingredients. Further, polyurethane and/or acrylic based primer compositions are preferred.

The primer compositions for use in the invention include water-based primer compositions, solvent-based primer compositions, and 100% solids compositions (e.g. extrudable). The primer composition may be unreactive or reactive. "Reactive" as used herein refers to a reaction of the ink composition with the primer composition. This term also refers to an anticipated reaction based on the presence of functional groups in the ink and primer composition that would reasonably be expected to react. Radiation curable primer compositions may be cured (e.g. crosslinked) prior to the primer coated surface being ink jetted with the radiation curable ink composition. Alternatively, the radiation curable primer and radiation curable ink may be cured concurrently. Upon evaporation of the solvent (e.g. water, organic solvent) and/or upon radiation curing, the primer composition forms a continuous film. The primer composition may be applied only to the portions that are to be ink jet printed. In such embodiments, the primer composition is typically also ink jetted and forms a continuous film over the span of the coated portion. However, the film is discontinuous with regard to the substrate surface as a whole.

The water-based and solvent-based primer compositions comprise one or more film-forming resins. Various film-forming resins are known. Representative film-forming resins include acrylic resin(s), polyvinyl resins, polyester, polyacrylates, polyurethane and mixtures thereof.

Polyester resins include copolyester resins commercially available from Bostik Inc., Middleton, Mass. under the trade designation "Vitel 2300BG"; copolyester resins available from Eastman Chemical, Kingsport, Tenn. under the trade designation "Eastar" as well as other polyester resins available from Bayer, Pittsburg, Pa. under the trade designations "Multron" and "Desmophen"; Spectrum Alkyd & Resins Ltd., Mumbia, Maharshtra, India under the trade designation "Spectraalkyd" and Akzo Nobel, Chicago, Ill. under the trade designation "Setalin" alkyd. Polyvinyl resins include vinyl chloride/vinyl acetate/vinyl alcohol terpolymer resins commercially available from Union Carbide Corp., a subsidiary of The Dow Chemical Company ("Dow"), Midland Mich. under the trade designation "UCAR VAGH". Other polyvinyl chloride resins are available from Occidental Chemical, Los Angeles, Calif.; BF Goodrich Performance Materials, Cleveland, Ohio; and BASF, Mount Olive, N.J. A suitable film forming acrylate resin is methylmethacrylate/butylmethacrylate copolymer commercially available from Rohm and Haas, Co., Philadelphia, Pa. under the trade designation "Paraloid B-66". Other polyacrylic materials include those from S.C. Johnson, Racine, Wis. under the trade designation "Joncryl" acrylics and Ineos Acrylics, Wildwood, Mo. under the trade designation "Elvacite" resins.

The film forming resin of the solvent-based primer composition is admixed with a solvent. The solvent may be a single substance or a blend of solvents. The primer composition preferably contains about 5 to about 80 parts by weight of the resin, more preferably about 10 to about 50 parts resin and most preferably about 15 to about 30 parts resin, based on the entire primer composition.

The solvent may be a single substance or a blend of solvents. Suitable solvents include water, alcohols such as isopropyl alcohol (IPA) or ethanol; ketones such as methyl ethyl ketone, methyl isobutyl ketone (MIBK), diisobutyl ketone (DIBK); cyclohexanone, or acetone; aromatic hydrocarbons such as toluene; isophorone; butyrolactone; N-methylpyrrolidone; tetrahydrofuran; esters such as lactates, acetates, including propylene glycol monomethyl ether acetate (PM acetate), diethylene glycol ethyl ether acetate (DE acetate), ethylene glycol butyl ether acetate (EB acetate), dipropylene glycol monomethyl acetate (DPM acetate); iso-alkyl esters such as isohexyl acetate, isoheptyl acetate, isooctyl acetate, isononyl acetate, isodecyl acetate, isododecyl acetate, isotridecyl acetate or other iso-alkyl esters; combinations of these and the like.

Preferred solvent-based and water-based primer compositions comprise at least about 25 percent by weight of the dry resin of an acrylic resin, and preferably at least about 50 percent by weight. Other preferred solvent-based and water-based primer compositions comprises at least about 10 percent by weight of the dry resin of a polyurethane, and preferably at least about 25 percent by weight. An exemplary solvent-based primer is commercially available from 3M under the trade designation "8801 Toner for Scotchlite Process Color Series Inks". Further, exemplary compositions for use as water-based primers include sulpho poly (ester urethane) compositions, such as described in U.S. Pat. No. 5,929,160, incorporated herein by reference.

A variety of radiation curable primer compositions and radiation curable ink compositions can be employed in the present invention. "Radiation curable" refers to functionality directly or indirectly pendant from a monomer, oligomer, or polymer backbone (as the case may be) that react (e.g. crosslink) upon exposure to a suitable source of curing energy. Whereas the radiation curable ink composition is typically self-crosslinking, the primer composition may react and bond with functional groups of the ink components or substrate, and thus, is not necessarily self-crosslinking. Such functionality generally includes not only groups that crosslink via a cationic mechanism upon radiation exposure but also groups that crosslink via a free radical mechanism. Representative examples of radiation crosslinkable groups suitable in the practice of the present invention include epoxy groups, (meth)acrylate groups, olefinic carbon—carbon double bonds, allyloxy groups, alpha-methyl styrene groups, (meth)acrylamide groups, cyanate ester groups, vinyl ethers groups, combinations of these, and the like. Free radically polymerizable groups are preferred. Of these, (meth)acryl moieties are most preferred. The term "(meth) acryl", as used herein, encompasses acryl and/or methacryl.

The energy source used for achieving crosslinking of the radiation curable functionality may be actinic (e.g., radiation having a wavelength in the ultraviolet or visible region of the spectrum), accelerated particles (e.g., electron beam radiation), thermal (e.g., heat or infrared radiation), or the like. Preferably, the energy is actinic radiation or accelerated particles, because such energy provides excellent control over the initiation and rate of crosslinking. Additionally, actinic radiation and accelerated particles can be used for curing at relatively low temperatures. This avoids degrading components that might be sensitive to the relatively high temperatures that might be required to initiate crosslinking of the radiation curable groups when using thermal curing techniques. Suitable sources of actinic radiation include mercury lamps, xenon lamps, carbon arc lamps, tungsten filament lamps, lasers, electron beam energy, sunlight, and the like. Ultraviolet radiation, especially from medium pressure mercury lamps, is most preferred.

The radiation curable primer compositions, as well as the radiation curable ink compositions may comprise a single radiation curable monomer, oligomer, macromonomer, polymer or various mixtures of such components. The radiation curable ingredient may be mono-, di-, tri-, tetra- or otherwise multifunctional in terms of radiation curable moieties.

As used herein, the term "monomer" means a relatively low molecular weight material (i.e., having a molecular weight less than about 500 g/mole). "Oligomer" means a relatively intermediate molecular weight (i.e., having a molecular weight of from about 500 up to about 100,000 g/mole). "Macromonomer" refers to a molecule having a molecular weight of about 3,000 g/mole to about 15,000 g/mole and preferably about 6,000 g/mole to about 10,000 g/mole that is made up of one or more repeating units and having one or more polymerizable groups, typically a polymerizable end group. "Polymer" means a molecule comprising a substructure formed from one or more monomeric, oligomeric, and/or polymeric constituents having repeating monomer substructure and that has no further radiation polymerizable groups. The term "molecular weight" as used throughout this specification means number average molecular weight, unless expressly noted otherwise.

The oligomers, macromonomers, and polymers may be straight-chained, branched, and/or cyclic with branched materials tending to have lower viscosity than straight-chain counterparts of comparable molecular weight.

For embodiments wherein it is desired that the cured primer and/or ink composition form an interpentrating polymer network, the monomer(s), oligomer(s), macromonomer(s) and polymer(s) may include a different kind (i.e. non-radiation curable) of crosslinking functionality such as pendant hydroxyl groups. In the presence of an isocyante crosslinking agent, pendant hydroxyl moieties will undergo urethane crosslinking reactions with the NCO groups.

Representative examples of monofunctional, radiation curable monomers include styrene, alpha-methylstyrene, substituted styrene, vinyl esters, vinyl ethers, N-vinyl-2-pyrrolidone, (meth)acrylamide, N-substituted (meth) acrylamide, octyl (meth)acrylate, nonylphenol ethoxylate (meth)acrylate, isononyl (meth)acrylate, isobornyl (meth) acrylate, 2-(2-ethoxyethoxy)ethyl (meth)acrylate, 2-ethylhexyl (meth)acrylate, lauryl (meth)acrylate, beta-carboxyethyl (meth)acrylate, isobutyl (meth)acrylate, cycloaliphatic epoxide, alpha-epoxide, 2-hydroxyethyl (meth)acrylate, (meth)acrylonitrile, maleic anhydride, maleimide and its derivatives, itaconic acid, isodecyl (meth) acrylate, dodecyl (meth)acrylate, n-butyl (meth)acrylate, methyl (meth)acrylate, hexyl (meth)acrylate, (meth)acrylic acid, N-vinylcaprolactam, stearyl (meth)acrylate, hydroxy functional caprolactone ester (meth)acrylate, isooctyl (meth) acrylate, hydroxyethyl (meth)acrylate, hydroxymethyl (meth)acrylate, hydroxypropyl (meth)acrylate, hydroxyisopropyl (meth)acrylate, hydroxybutyl (meth)acrylate, hydroxyisobutyl (meth)acrylate, tetrahydrofurfuryl (meth) acrylate, combinations of these, and the like.

Examples of multifunctional, radiation curable monomers include ethylene glycol di(meth)acrylate, hexanediol di(meth)acrylate, triethylene glycol di(meth)acrylate, tetraethylene glycol di(meth)acrylate, trimethylolpropane tri (meth)acrylate, ethoxylated trimethylolpropane tri(meth) acrylate, glycerol tri(meth)acrylate, pentaerythritol tri(meth) acrylate, pentaerythritol tetra(meth)acrylate, and neopentyl glycol di(meth)acrylate, combinations of these, and the like.

Suitable repeating units of the macromonomers include ethylenically unsaturated carboxylic acids, esters, and other groups that do not interfere with the radiation curing. Polymerizable end groups of the macromonomer include acrylic acid and methacrylic acid. Preferred macromonomers include compounds of the formula (I) or (II):

$$R—(R_1)_n—(CH_2)_{1-5}—R2—X \quad (I)$$

$$R—(R1)_n—X \quad (II)$$

wherein

R is H, $C_{1-20}$, alkyl which may be straight-chain or branched, or $C_{1-20}$, alkoxy which may be straight-chain or branched;

R2 is $C_{1-20}$, alkylene which may be straight or branched and which may be interrupted by one or more —CONR3—, —NR3CO—, —COO—, or —OCO— linkages;

R1 is

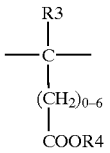

wherein R3 and R4 are each independently H or $C_{1-6}$ alkyl which may be straight-chain or branched;

X is

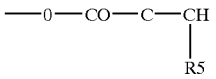

wherein R5 is H or $C_{1-6}$, alkyl; and n is a number sufficient to provide the desired molecular weight, typically about 10 to 210.

Preferred macromonomers are those having methylmethacrylate, isobutyl methacrylate or isobutylmethacrylate/isooctylacrylate repeating unit and a methacrylic end group. Suitable methylmethacrylate macromonomers are available commercially as macromonomer resins AA-10 and AA-6 from Toagosei Co. LTD, Tokyo, Japan and macromonomer resin ELVACITE EP-M1010 from Ineos Acrylics, Inc., Wildwood, Mo.

Suitable radiation curable oligomers and polymers include (meth)acrylated urethanes (i.e., urethane (meth) acrylates), (meth)acrylated epoxies (i.e., epoxy (meth) acrylates), (meth)acrylated polyesters (i.e., polyester (meth) acrylates), (meth)acrylated (meth)acrylics, (meth)acrylated silicones, (meth)acrylated polyethers (i.e., polyether (meth) acrylates), vinyl (meth)acrylates, and (meth)acrylated oils. Preferred (meth)acrylated aliphatic urethanes are di(meth) acrylate esters of hydroxy terminated NCO extended aliphatic polyesters or aliphatic polyethers. (Meth)acrylated polyesters are the reaction products of (meth)acrylic acid with an aliphatic dibasic acid/aliphatic diol-based polyester.

Examples of commercially available (meth)acrylated urethanes and polyesters include those commercially available from Henkel Corp., Hoboken, N.J. under the trade designation "Photomer"; commercially available from UCB Radcure Inc., Smyrna, Ga. under the trade designation "Ebecryl" series 284, 810, 4830, 8402, 1290, 1657, 1810, 2001, 2047, 230, 244, 264, 265, 270, 4833, 4835, 4842, 4866, 4883, 657, 770, 80, 81, 811, 812, 83, 830, 8301, 835, 870, 8800, 8803, 8804; commercially available from Sartomer Co., Exton, Pa. under the trade designation "Sartomer CN" series CN964 B-85, CN292, CN704, CN816, CN817, CN818, CN929, CN944B-85, CN945A-60, CN945B-85, CN953, CN961, CN962, CN963, CN 965, CN966, CN968, CN980, CN981, CN982, CN983, CN984, CN985; commercially available from Akcross Chemicals, New Brunswick, N.J. under the trade designation "Actilane"; and commercially available from Morton International, Chicago, Ill. under the trade designation "Uvithane".

Preferred acrylated acrylics are acrylic oligomers or polymers that have reactive pendant or terminal (meth)acrylic acid groups capable of forming free radicals for subsequent reaction. Examples of commercially available (meth) acrylated acrylics include those commercially available from UCB Radcure Inc. under the trade designation "Ebecryl" series 745, 754, 767, 1701, and 1755.

A preferred radiation curable oligomer is a polyester polyurethane oligomer that is the reaction product of an aliphatic polyisocyanate comprising two or more isocyanate groups; and a radiation curable alcohol comprising one or more radiation curable moieties, one or more hydroxyl moieties, and one or more polycaprolactone ester moieties. The radiation curable alcohol preferably has the formula

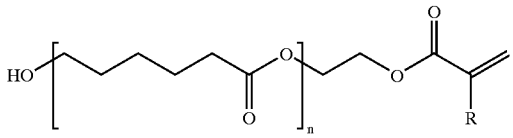

wherein n has a range from about 1–10, preferably from about 2 to 5 such that the radiation curable alcohol is soluble in a reactive diluent; R is a monovalent substituent. The polyisocyanate preferably comprises 2,2,4-trimethylhexamethylene diisocyanate; 2,4,4-trimethylhexamethylene diisocyanate, and mixtures thereof employed in combination with at least one of isophorone diisocyanate and/or an isocyanate functional isocyanurate. Alternatively, the polyisocyanate may comprise a compound of the formula

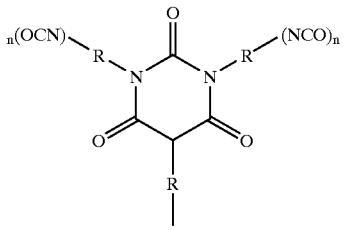

wherein each R is independently an n+1 valent moiety and each n independently is 1 to 3.

For outdoor applications, polyurethane and acrylic-containing monomer(s), macromonomer(s), oligomer(s) and polymer(s) are preferred. The higher molecular weight species also tend to be readily soluble in reactive diluents.

Provided that at least one of the ingredients is radiation curable, the radiation curable primer and/or ink composition may comprise non-radiation curable ingredients as well. For example, polymers such as polyurethanes, acrylic material, polyesters, polyimides, polyamides, epoxies, polystryene as well as substituted polystyrene containing materials, silicone containing materials, fluorinated materials, combinations thereof, and the like, may be combined with reactive diluents (e.g. monomers).

In some embodiments, the radiation curable primer composition is substantially the same as the radiation curable ink composition. The primer composition is typically substantially free of colorant, particularly when applied to the entire surface of the article. However, the primer may also contain colorants, the colored primer layer being suitable for use as a color layer. Alternatively, uncolored primer may be only applied directly beneath the image wherein the primed surface corresponds substantially identically in size and shape to the image.

To the extent that the primer composition and the radiation curable ink composition are the same, the forthcoming discussion concerning preferred radiation curable ink compositions is also applicable to radiation curable primer compositions, particularly in the case of primers delivered to the substrate surface by means of ink jet printing.

The primed polymeric sheet is imaged with a radiation curable ink. Radiation curable inks and in particular UV curable inks for ink jet printing are known. Representative ink jet compositions for use in the invention include compositions such as described in U.S. Pat. No. 5,275,646, U.S. Pat. No. 5,981,113, WO 97/31071, and WO 99/29788.

Whereas the radiation curable primer may have a viscosity ranging from about 5 centipoise to about 10,000 centipoise depending on the intended coating method, the radiation curable inks characteristicly have a low viscosity. Preferably, the ink compositions, as well as the ink jettable primer, have a viscosity below about 30 centipoise, more preferably below about 25 centipoise, and most preferably below about 20 centipoise at the desired ink jetting temperature (typically from ambient temperature up to about 65° C.). Due to potential volatility and reactivity of one or more constituents of radiation curable compositions, the radiation curable ink compositions are typically jetted at temperatures no higher than about 65° C., and preferably no higher than about 50° C. The optimum viscosity characteristics for a particular composition will depend upon the jetting temperature and the type of ink jet system that will be used to apply the composition onto the substrate. For example, for piezo ink jet applications, a typical desired viscosity is about 3 to about 30 centipoise at the print head temperature. Ink jet compositions as well as ink jettable primer compositions typically have moderate to low surface tension properties prior to curing. Preferred formulations have a surface tension in the range of from about 20 mN/m to about 50 mN/m and more preferably in the range of from about 22 mN/m to about 40 mN/m at the printhead operating temperature.

Further, preferred ink compositions and ink jettable primer compositions also have Newtonian or substantially Newtonian viscosity properties prior to curing. A Newtonian fluid has a viscosity that is at least substantially independent of shear rate. As used herein, the viscosity of a fluid will be deemed to be substantially independent of shear rate, and hence at least substantially Newtonian, if the fluid has a power law index of 0.95 or greater. The power law index of a fluid is given by the expression $$\eta = m\gamma^{n-1}$$

wherein $\eta$ is the shear viscosity, $\gamma$ is the shear rate in $s^{-1}$, m is a constant, and n is the power law index. The principles of the power law index are further described in C. W. Macosko, "Rheology: Principles, Measurements, and Applications", ISBN #1-56081-579-5, page 85.

A preferred radiation curable ink composition comprises a radiation curable reactive diluent, one or more oligomers(s), macromonomer(s) and polymer(s), and one or more optional adjuvants. Preferred oligomers(s), macromonomer(s) and polymer(s) have a number average molecular weight below about 100,000, preferably from about 500 to about 30,000, and more preferably from about 700 to about 10,000.

As general guideline, preferred ink jet compositions include from about 0.1 to about 50 weight percent of oligomers(s), macromonomer(s) and polymer(s). In the case of the higher molecular weight polymeric species, the ink composition typically comprises from about 0.1 to about 30 and preferably from about 5 to about 20 weight percent polymer. In the case of lower molecular weight oligomeric and macromonomeric species, the ink composition comprises from about 0.1 to about 50 and preferably from about 15 to about 40 weight percent oligomer or macromonomer.

Suitable oligomers(s), macromonomer(s) and polymer(s) for the ink composition may be non-reactive or optionally functional, both of which have been previously described.

The reactive diluent of the ink composition generally comprises one or more radiation curable monomers, as previously described. The monomer(s) function as diluents or solvents, as viscosity reducers, as binders when cured, and optionally as crosslinking agents. Preferred radiation curable ink compositions typically contain from about 25 to about 100 and preferably from about 40 to about 90 weight percent of such monomers.

The radiation curable primers and/or ink compositions may be formulated with one or more radiation curable monomers or combinations thereof that contribute certain performance criteria to the cured ink and/or primer.

Multifunctional radiation curable materials (e.g. multifunctional monomers), such as previously described, may be incorporated into the reactive diluent to enhance crosslink density, hardness, tackiness, mar resistance, or the like. If one or more multifunctional materials are present, the reactive diluent may comprise from about 0.5 to about 50, preferably about 0.5 to about 35, and more preferably from about 0.5 to about 25 weight percent of such multifunctional materials.

Alternatively, or in addition thereto, in order to promote hardness and abrasion resistance, a "high Tg component" radiation curable monomer may be incorporated that results in the cured material having a higher glass transition temperature, Tg, as compared to an otherwise identical formulation lacking such high Tg component. The Tg of a monomer refers to the glass transition temperature of a cured film of a homopolymer of the monomer, in which Tg is measured by differential scanning calorimetry (DSC) techniques. Preferred monomeric constituents for use as a high Tg component generally include monomers whose homopolymers have a Tg of at least about 50° C., preferably at least about 60° C., and more preferably at least about 75° C. in the cured state. When used, the high Tg component may constitute about 0.5 to about 50, preferably about 0.5 to about 40, and more preferably about 0.5 to about 30 weight percent of the radiation curable, reactive diluent. An exemplary class of high Tg components generally comprises monomers having at least one (meth)acrylate moiety and at least one nonaromatic, alicyclic and/or nonaromatic heterocyclic moiety, such as isobornyl (meth)acrylate. 1,6-Hexanediol di(meth)acrylate is another representative high Tg component monomer.

Alternatively or in addition thereto, an "adhesion promoting component" may be incorporated into the primer and/or ink compositions, that causes the uncured and/or cured material to have higher adhesion to the desired receiving substrate as compared to an otherwise identical formulation lacking such adhesion promoting component. Adhesion promoting monomers tend to diffuse into the substrate or primer to form a physical lock when cured. It is preferred to employ about 0.1 to about 50 weight of an adhesion promoting component comprising one or more relatively low Tg heterocyclic, radiation curable monomers and/or an alkoxylated monomer comprising pendant alkoxylated functionality. As used herein, low Tg means that a cured homopolymer film of the monomer has a Tg less than about 40° C., preferably less than about 10° C., and more preferably less than about −10° C. Alkoxylated monomers having main chain functionality may also be employed with the proviso that the concentration of such does not exceed about 10 weight percent of the total reactive diluent concentration.

Illustrative embodiments of low Tg heterocyclic, radiation curable monomers includes tetrahydrofurfuryl acrylate and vinyl caprolactam. A specific example of a monomer comprising pendant alkoxylated functionality includes 2-(2-ethoxyethoxy)ethyl (meth)acrylate; whereas propoxyethyl (meth)acrylate and propoxylated neopentyl glycol di(meth) acrylate comprise main chain alkoxylated functionality.

Combinations of monomers with adhesion promoting characteristics are advantageous. One particularly preferred combination comprises 1 to 10 parts by weight of an alkoxylated (meth)acrylate per 5 to 15 parts by weight of a heterocyclic (meth)acrylate. A particularly preferred embodiment of such a combination comprises 2-(2-ethoxyethoxy)ethyl (meth)acrylate and tetrahydrofurfuryl (meth)acrylate. The primer composition and in particular the ink composition may incorporate one or more monomers (hereinafter gloss component) into the reactive diluent whose presence provides cured, printed features with better initial gloss and or gloss retention as compared to otherwise identical films lacking such gloss component. Preferred radiation curable reactive diluents comprise a sufficient amount of a gloss component such that a cured, homopolymer film of the material has a 60° gloss of at least 70 preferably at least 90 when measured according to ASTM D 523 Standard Test Method for Specular Gloss. When a gloss component is used, reactive diluents may comprise 0.5 to 30, preferably 0.5 to 15, more preferably 0.5 to 10 weight percent of the gloss component.

A wide variety of suitable monomers may be incorporated singly or in combination into the gloss component. One such class of monomers comprises radiation curable monomers that are solids at room temperature such as N-vinylcaprolactam and N-vinylpyrrolidinone.

Preferred components for enhanced wetting component have a low surface tension of about 30 mN/m or less. One class of monomers that enhance wetting comprises at least one (meth)acrylate moiety and at least one aliphatic moiety that is straight chained or branched. Preferably, the aliphatic moiety is a branched hydrocarbyl moiety containing 3 to 20 carbon atoms. Specific examples include isooctyl acrylate and (meth)acrylate monomers comprising branched hydrocarbon moieties including 3 to 20 carbon atoms.

The various reactive diluents can be combined to obtain the desired balance of properties. For example, one such reactive diluent embodiment comprises 10 to 40 weight percent of the high Tg component (preferably isobornyl (meth)acrylate), 15 to 50 weight percent of the adhesion promoting component (preferably a combination of 1 to 20 parts by weight of 2-(2-ethoxyethoxy)ethyl (meth)acrylate per 1 to 20 parts by weight of tetrahydrofurfuryl (meth) acrylate), 5 to 10 weight percent of the gloss component (preferably N-vinylcaprolactam), 5 to 20 weight percent of a multifunctional radiation curable monomer (preferably 1,6-hexanediol di(meth)acrylate), and 5 to 20 weight percent of the low surface tension component (preferably isooctyl (meth)acrylate).

Another illustrative, preferred reactive diluent of the present invention comprises 30 to 50 weight percent of a high Tg component (preferably isobornyl (meth)acrylate), 30 to 50 weight percent of a adhesion promoting component (preferably 2(2-ethoxyethoxy)ethyl (meth)acrylate and/or tetrahydrofurfuryl (meth)acrylate), and 5 to 15 weight percent of a multifunctional radiation curable monomer (preferably 1,6-hexanediol di(meth)acrylate).

The uncured ink jet compositions (i.e. primer and/or ink) may contain solvent or be substantially free of solvent. Substantially free of solvent means that the uncured composition contains less than 10, preferably less than 2, and more preferably less than 0.5 weight percent of solvent prior to application to the receiving substrate. Preferred solvents desirably have a surface tension that is at least 2 mN/m below the surface tension of the reactive diluent; provided, however, that the more preferred solvents additionally have a surface tension that is less than about 30 mN/m at 25° C. and preferably less than about 28 mN/m at 25° C. The preferred solvents also desirably have a relatively high flash point of at least about 50° C., and preferably at least about 60° C.

As general guidelines, radiation curable ink and primer compositions of the present invention may comprise 0.1 to 40, preferably 0.5 to 15, more preferably 1 to about 10 weight percent of the solvent component.

The solvent component may comprise one or more solvents, as previously described that may be aqueous or organic, polar or nonpolar, or the like. Organic solvents tend to dry more readily during radiation curing. Esters, particularly those comprising branched aliphatic moieties such as iso-alkyl moieties, are one class of preferred solvent.

The primer and ink composition may comprise a variety of optional additives. Such optional additives include one or more flow control agents, photoinitiators, colorants, slip modifiers, thixotropic agents, foaming agents, antifoaming agents, flow or other rheology control agents, waxes, oils, polymeric materializers, binders, antioxidants, photoinitiator stabilizers, gloss agents, fungicides, bactericides, organic and/or inorganic filler particles, leveling agents, opacifiers, antistatic agents, dispersants, and the like.

To enhance durability of a printed image graphic, especially in outdoor environments exposed to sunlight, a variety of commercially available stabilizing chemicals can be added optionally to the inks and primer compositions. These stabilizers can be grouped into the following categories: heat stabilizers, ultra-violet light stabilizers, and free-radical scavengers.

Heat stabilizers are commonly used to protect the resulting image graphic against the effects of heat and are commercially available from Witco Corp., Greenwich, Conn. under the trade designation "Mark V 1923" and Ferro Corp., Polymer Additives Div., Walton Hills, Ohio under the trade designations "Synpron 1163", "Ferro 1237" and "Ferro 1720". Such heat stabilizers can be present in amounts ranging from about 0.02 to about 0.15 weight percent.

Ultraviolet light stabilizers can be present in amounts ranging from about 0.1 to about 5 weight percent of the total primer or ink. Benzophenone type UV-absorbers are commercially available from BASF Corp., Parsippany, N.J. under the trade designation "Uvinol 400"; Cytec Industries, West Patterson, N.J. under the trade designation "Cyasorb UV 1164" and Ciba Specialty Chemicals, Tarrytown, N.Y., under the trade designations "Tinuvin 900", "Tinuvin 123" and "Tinuvin 1130".

Free-radical scavengers can be present in an amount from about 0.05 to about 0.25 weight percent of the total primer or ink composition. Nonlimiting examples of free-radical scavengers include hindered amine light stabilizer (HALS) compounds, hydroxylamines, sterically hindered phenols, and the like.

HALS compounds are commercially available from Ciba Specialty Chemicals under the trade designation "Tinuvin 292" and Cytec Industries under the trade designation "Cyasorb UV3581".

A wide variety of other gloss agents may be used. Examples include aminobenzoates, secondary amines, silicones, waxes, morpholine adducts, materials available under trade designations "Sartomer" CN386, CN381, CN383, and the like.

The pigment used in the ink composition provides the desired color. Pigments and/or dyes can also be incorporated into the primer, as previously described. Durable pigments are preferred for use in the inks, whereas durable pigments and/or dyes are preferred for the primer, meaning that the pigments and/or dyes exhibit good outdoor durability and resist fading upon exposure to sun light and the elements.

Pigments useful in the invention may be organic or inorganic. Suitable inorganic pigments include carbon black and titania ($TiO_2$), while suitable organic pigments include phthalocyanines, anthraquinones, perylenes, carbazoles, monoazo- and disazobenzimidazolones, isoindolinones, monoazonaphthols, diarylidepyrazolones, rhodamines, indigoids, quinacridones, diazopyranthrones, dinitranilines, pyrazolones, dianisidines, pyranthrones, tetrachloroisoindolinones, dioxazines, monoazoacrylides, anthrapyrimidines. It will be recognized by those skilled in the art that organic pigments will be differently shaded, or even have different colors, depending on the functional groups attached to the main molecule.

Commercially available examples of useful organic pigments include those described in The Colour Index, Vols. 1–8, Society of Dyers and Colourists, Yorkshire, England having the designations Pigment Blue 1, Pigment Blue 15, Pigment Blue 15: 1, Pigment Blue 15:2, Pigment Blue 15:3, Pigment Blue 15:4, Pigment Blue 15:6, Pigment Blue 16, Pigment Blue 24, and Pigment Blue 60 (blue pigments); Pigment Brown 5, Pigment Brown 23, and Pigment Brown 25 (brown pigments); Pigment Yellow 3, Pigment Yellow 14, Pigment Yellow 16, Pigment Yellow 17, Pigment Yellow 24, Pigment Yellow 65, Pigment Yellow 73, Pigment Yellow 74, Pigment Yellow 83, Pigment Yellow 95, Pigment Yellow 97, Pigment Yellow 108, Pigment Yellow 109, Pigment Yellow 110, Pigment Yellow 113, Pigment Yellow 128, Pigment Yellow 129, Pigment Yellow 138, Pigment Yellow 139, Pigment Yellow 150, Pigment Yellow 154, Pigment Yellow 156, and Pigment Yellow 175 (yellow pigments); Pigment Green 1, Pigment Green 7, Pigment Green 10, and Pigment Green 36 (green pigments); Pigment Orange 5, Pigment Orange 15, Pigment Orange 16, Pigment Orange 31, Pigment Orange 34, Pigment Orange 36, Pigment Orange 43, Pigment Orange 48, Pigment Orange 51, Pigment Orange 60, and Pigment Orange 61 (orange pigments); Pigment Red 4, Pigment Red 5, Pigment Red 7, Pigment Red 9, Pigment Red 22, Pigment Red 23, Pigment Red 48, Pigment Red 48:2, Pigment Red 49, Pigment Red 112, Pigment Red 122, Pigment Red 123, Pigment Red 149, Pigment Red 166, Pigment Red 168, Pigment Red 170, Pigment Red 177, Pigment Red 179, Pigment Red 190, Pigment Red 202, Pigment Red 206, Pigment Red 207, and Pigment Red 224 (red pigments); Pigment Violet 19, Pigment Violet 23, Pigment Violet 37, Pigment Violet 32, and Pigment Violet 42 (violet pigments); and Pigment Black 6 or 7 (black pigments).

Dyes are generally chosen based on their solubility with the polymeric material of the primer. Suitable dyes for acrylic-containing (e.g. crosslinked poly (meth)acrylate) primers include anthraquinone dyes, such as commercially available from Bayer Corp., Coatings and Colorants Division, Pittsburgh Pa. under the trade designation "Macrolex Red GN" and "Macrolex Green SB" and commercially available from BASF Akt., Ludwigshafen, Germany under the trade designation "Thermoplast Red 334" and "Thermoplast Blue 684"; pyrazolone dyes, such as commercially available from BASF Akt. under the trade designation "Thermoplast Yellow 104"; and perinone dyes, such as commercially available from Bayer Corp. under the trade designation "Macrolex Orange 3G."

The pigment is generally incorporated into the ink and/or primer composition by milling the pigment into selected reactive monomer(s), macromonomer(s), oligomer(s) and/or polymer(s). If the ink is to be used in applications wherein the ink is used in combination with a retroreflective backing, the pigment must be milled to a particle size that provides sufficient transparency to permit retroreflection and provide retroreflective color. This may be accomplished, for example, by milling the pigment.

If a colorant in the form of pigment is used, a dispersant may be desired in some instances in order to stabilize the pigment. The choice of dispersant depends on factors such as the type of pigment used, the type of monomer(s), oligomer(s), macromonomer(s) and polymer(s) in the formulation, the composition of the phase(s) into which the pigment will be dispersed, and the like. Examples of suitable dispersants include those commercially available from Avecia Inc., Wilmington, Del. under the trade designation "Solsperse"; The Lubrizol Corp., Wickliff, Ohio under the trade designation "EFKA"; and BYK Chemie, USA of Wallingford, Conn. under the trade designation "BYK". It is possible to use mixtures of dispersants also. The amount of dispersant added depends on the type and concentration of the pigment. Typically about 20 to about 100 parts by weight of dispersant are used per 100 parts by weight of organic pigment, and between about 5 to about 80 parts by weight of the dispersant per 100 parts by weight inorganic pigment. Desirably, to avoid destabilizing the ink, the dispersant has a higher affinity for the pigment than for the other ingredients of the ink and/or primer composition.

The inks as well as the UV curable primers are cured using UV radiation, which typically benefits from the presence of at least one photoinitiator. In the case of electron beam curing, however, photoinitiators are not required. The type of photoinitiator used depends on the choice of colorant in the composition and on the wavelength of the radiation. Commercially available free-radical generating photoinitiators suitable for the invention include, but are not limited to benzophenone, benzoin ether and acylphosphine photoinitiators such as those commercially available from Ciba Specialty Chemicals under the trade designations "Irgacure" and Darocur".

The colorant in the ink and/or primer will absorb part of the incident radiation, depleting the available energy to activate the photoinitiator(s). This will slow down the curing rate and may result in poor through and/or surface cure of the applied ink. It is therefore preferred to use a mixture of photoinitiators in order to provide both surface and through cure. The amount of photoinitiator(s) used typically varies between about 1 and about 15 weight percent, preferably between about 3 and about 12 weight percent and more preferably between about 5 and about 10 weight percent for formulations containing colorant. The uncolored inks and primers can have lower initiator concentrations. Co-initiators and amine synergists can be included in order to improve curing rate. Examples include isopropylthioxanthone, ethyl-4-(dimethylamino)benzoate, 2-ethylhexyl dimethylaminobenzoate, and dimethylaminoethyl methacrylate.

The ink and primer compositions are made by mixing together the desired ingredients using any suitable technique. For example, in a one step approach, all of the ingredients are combined and blended, stirred, milled, or otherwise mixed to form a homogeneous composition. As another alternative, at least some of the components of the and at least some of the solvent or reactive diluent may be blended together in a first step. Then, in one or more additional steps, the remaining constituents of the component if any, and one or more additives may be incorporated into the composition via blending, milling, or other mixing technique.

As still yet another approach which is particularly preferred when pigment colorants are to be included, a preferred processing approach involves preparing the composition such that the pigment particle size of the colorant is less than 5 micrometers, preferably less than 1 micrometers, ideally less than 0.5 micrometers. The particle size of the pigment colorant may be characterized by an appropriate method such as dynamic light scattering (DLS) or microscopy. Ink jettable compositions comprising such fine pigment colorants provide excellent color saturation, transparency, and jettability, especially for applications in which the composition is a colored ink that is printed onto retroreflective signage of outdoor signage.

Initially, a dispersion is prepared containing from about 1 to about 80 weight percent of the pigment colorant with the balance being reactive diluent, and other additives, if desired. At this stage, the pigment may be incorporated into the dispersion as supplied by the vendor. Subsequent milling will reduce the pigment size to the desired fine particle size. This initial dispersion may be prepared by first predissolving a dispersant in the liquid components and then adding the desired amount of pigment powder. Initial wetting of pigment is accomplished with high shear mixing. Next, the dispersion is subjected to high energy milling techniques such as ball milling, sand milling, horizontal media milling, attritor milling, or 2- or 3-roll mills, or the like in order to reduce the pigment to the desired particle size. Following the milling, the resultant dispersion is exceptionally stable (i.e. the dispersion remains homogeneous and particle size does not increase over long periods of time, e.g., 26 weeks). Following the milling procedure, the pigment dispersion may be diluted with additional solvents, monomers, oligomers, macromonomer, polymers, dispersants, flow agents, surfactants, photoinitiators, UVA, HALS, and/or the like. The millbase also remains stable following the addition and incorporation of these additional components. See, e.g., Patton "*Paint Flow and Pigment Dispersion*", ISBN #0-471-89765-5.

During the manufacture of the articles of the invention, the primer composition is applied to a surface of the substrate. The primer may be applied with any suitable coating technique including screen printing, spraying, ink jetting, extrusion-die coating, flexographic printing, offset printing, gravure coating, knife coating, brushing, curtain coating, wire-wound rod coating, bar coating and the like. The primer is typically applied directly to the substrate. Alternatively, the primer may be coated onto a release liner and transfer coated onto the substrate. However, for embodiments wherein the primer surface is exposed and thus is non-tacky, additional bonding layers may be required.

For embodiments wherein the primer composition is ink-jetted, the primer composition is substantially free of colorant or comprised of a composition that is different than the base composition of the ink. "Base composition" refers to the composition of the ink absent colorant. The ink-jetted primer is preferably applied in a manner that corresponds substantially identically in size and shape to the image. The primer may be applied to a portion of the image at a time, just prior to application of each individual color. Alternatively, the primer may be applied to all the surface portions that are to be imaged in a single pass.

After being coated, the solvent-based and water-based compositions are dried. The coated substrates are preferably dried at room temperature for at least 24 hours. Alternatively the coated substrates may be dried in a heated oven ranging in temperature from about 40° C. to about 70° C. for about 5 to about 20 minutes followed by room temperature drying for about 1 to 3 hours.

The radiation curable ink and primer compositions may be cured using a suitable fluence and type of curing energy. The primer composition may be cured prior to imaging via ink jetting. Alternatively, the radiation curable ink jet composition may be jetted onto uncured primer, the ink and primer being cured concurrently. The amount of curing energy to be used for curing depends upon a number of factors, such as the amount and the type of reactants involved, the energy source, web speed, the distance from the energy source, and the thickness of the material to be cured. Generally, the rate of curing tends to increase with increased energy intensity. The rate of curing also may tend to increase with increasing amounts of photocatalyst and/or photoinitiator being present in the composition. As general guidelines, actinic radiation typically involves a total energy exposure from about 0.1 to about 10 Joules per square centimeter, and electron beam radiation typically involves a total energy exposure in the range from less than 1 megarad to 100 megarads or more, preferably 1 to 10 megarads. Exposure times may be from less than about 1 second up to 10 minutes or more. The radiation exposure may occur in air or in an inert atmosphere such as nitrogen.

The imaged, polymeric sheets may be a finished product or an intermediate and is useful for a variety of articles including signage and commercial graphics films. Signage include various retroreflective sheeting products for traffic control as well as non-retroreflective signage such as backlit signs.

The article is suitable for use as roll-up signs, flags, banners and other articles including other traffic warning items such as roll-up sheeting, cone wrap sheeting, post wrap sheeting, barrel wrap sheeting, license plate sheeting, barricade sheeting and sign sheeting; vehicle markings and segmented vehicle markings; pavement marking tapes and sheeting; as well as retroreflective tapes. The article is also useful in a wide variety of retroreflective safety devices including articles of clothing, construction work zone vests, life jackets, rainwear, logos, patches, promotional items, luggage, briefcases, book bags, backpacks, rafts, canes, umbrellas, animal collars, truck markings, trailer covers and curtains, etc.

In the case of retroreflective articles, the coefficient of retroreflection of the viewing surface depending on the desired properties of the finished article. In general, however, the retroreflective layer typically has a coefficient of retroreflection ranging from about 5 candelas per lux, for colored retroreflective layers, to about 1500 candelas per lux per square meter at 0.2 degree observation angle and −4 degree entrance angle, as measured according to ASTM E-810 test method for coefficient of retroreflection of retroreflective sheeting. For cube corner sheeting the coefficient of retroreflection is preferably at least about 200 candelas per lux for fluorescent orange and at least about 550 candelas per lux for white.

The two most common types of retroreflective sheeting suitable for use are microsphere-based sheeting and cube corner-based sheeting. Microsphere sheeting, sometimes referred to as "beaded sheeting," is well known to the art and includes a multitude of microspheres typically at least partially embedded in a binder layer, and associated specular or diffuse reflecting materials (such as metallic vapor or sputter coatings, metal flakes, or pigment particles). "Enclosed-lens" based sheeting refers to retroreflective sheeting in which the beads are in spaced relationship to the reflector but in full contact with the resin. The "encapsulated lens" retroreflective sheeting is designed such that the reflector is in direct contact with the bead but the opposite side of the bead is in a gas interface. Illustrative examples of microsphere-based sheeting are disclosed in U.S. Pat. Nos. 4,025,159 (McGrath); 4,983,436 (Bailey); 5,064,272 (Bailey); 5,066,098 (Kult); 5,069,964 (Tolliver); and 5,262,225 (Wilson).

Cube corner sheeting, sometimes referred to as prismatic, microprismatic, or triple mirror reflector sheetings, typically includes a multitude of cube corner elements to retroreflect incident light. Cube corner retroreflectors typically include a sheet having a generally planar front surface and an array of cube corner elements protruding from the back surface. Cube corner reflecting elements include generally trihedral structures that have three approximately mutually perpendicular lateral faces meeting in a single corner—a cube corner. In use, the retroreflector is arranged with the front surface disposed generally toward the anticipated location of intended observers and the light source. Light incident on the front surface enters the sheet and passes through the body of the sheet to be reflected by each of the three faces of the elements, so as to exit the front surface in a direction substantially toward the light source. In the case of total internal reflection, the air interface must remain free of dirt, water and adhesive and therefore is enclosed by a sealing film. The light rays are typically reflected at the lateral faces due to total internal reflection, or by reflective coatings, as previously described, on the back side of the lateral faces. Preferred polymers for cube corner sheeting include poly(carbonate), poly(methylmethacrylate), poly(ethyleneterephthalate), aliphatic polyurethanes, as well as ethylene copolymers and ionomers thereof. Cube corner sheeting may be prepared by casting directly onto a film, such as described in U.S. Pat. No. 5,691,846 (Benson) incorporated herein by reference. Preferred polymers for radiation cured cube corners include cross linked acrylates such as multifunctional acrylates or epoxies and acrylated urethanes blended with mono-and multifunctional monomers. Further, cube corners such as those previously described may be cast on to plasticized polyvinyl chloride film for more flexible cast cube corner sheeting. These polymers are preferred for one or more reasons including thermal stability, environmental stability, clarity, excellent release from the tooling or mold, and capability of receiving a reflective coating.

In embodiments wherein the sheeting is likely to be exposed to moisture, the cube corner retroreflective elements are preferably encapsulated with a seal film. In instances wherein cube corner sheeting is employed as the retroreflective layer, a backing layer may be present for the purpose of opacifying the laminate or article, improving the scratch and gouge resistance thereof, and/or eliminating the blocking tendencies of the seal film. Illustrative examples of cube corner-based retroreflective sheeting are disclosed in U.S. Pat. Nos. 5,138,488 (Szczech); 5,387,458 (Pavelka); 5,450,235 (Smith); 5,605,761 (Burns); 5,614,286 (Bacon) and 5,691,846 (Benson, Jr.).

Commercial graphic films include a variety of advertising, promotional, and corporate identity imaged films. The films typically comprise a pressure sensitive adhesive on the non-viewing surface in order that the films can be adhered to a target surface such as an automobile, truck, airplane, billboard, building, awning, window, floor, etc.

EXAMPLES

Objects and advantages of the invention are further illustrated by the following examples, but the particular materials and amounts thereof recited in the examples, as well as other conditions and details, should not be construed to unduly limit the invention. All parts, percentages and ratios herein are by weight unless otherwise specified.

TABLE A

Substrates Used in the Examples

| Abbreviation | "Trade Designation" | Source | Location |
|---|---|---|---|
| 510-10 | "Scotchlite Reflective Sheeting Series 510-10" | 3M | St. Paul, MN |
| 810 | "Scotchlite Basic Grade Reflective Sheeting Series 810" | 3M | St. Paul, MN |
| HI | "Scotchlite High Intensity Grade Reflective Sheeting Series 3870" | 3M | St. Paul, MN |
| DG | "Scotchlite Diamond Grade LDP Reflective Sheeting Series 3970" | 3M | St. Paul, MN |
| 3540C | "Controltac *Plus* Changeable Graphic Film with Comply Performance 3540C" | 3M | St. Paul, MN |
| 180-10 | "Controltac *Plus* Graphic Film 180-10" | 3M | St. Paul, MN |
| 160C-30 | "Controltac *Plus* Graphic Film with Comply Performance Series 160C-30" | 3M | St. Paul, MN |
| Panaflex 930 | "Panaflex Awning and Sign Facing 930" | 3M | St. Paul, MN |
| Panaflex 931 | "Panaflex Awning and Sign Facing 931" | 3M | St. Paul, MN |
| Panaflex 945 | "Panaflex Awning and Sign Facing 945 GPS" | 3M | St. Paul, MN |
| 2033 | "Spunbond PET Non-woven Film Style 2033" | Reemay, Inc. | Old Hickory, TN |

TABLE A-continued

| Substrates Used in the Examples | | | |
|---|---|---|---|
| Abbreviation | "Trade Designation" | Source | Location |
| SP 700 | "Teslin SP 700"* | PPG Industries | Pittsburgh, PA |

*Teslin SP 700 = Microporous, high molecular weight polyethylene film filled with silica having a thickness of 177.8 microns.

TABLE B

| Ingredients in Ink Compositions Used in the Examples | | | |
|---|---|---|---|
| Chemical Name/Description | "Trade Designation"/ Abbreviation | Source | Location |
| | Monomers | | |
| 2-(2-Ethoxyethoxy)ethyl acrylate | EEEA | Sartomer Co. | Exton, PA |
| Isobornyl acrylate | IBOA | Sartomer Co. | Exton, PA |
| 1,6-Hexanediol diacrylate | HDDA | Sartomer Co. | Exton, PA |
| Tetrahydrofurfuryl acrylate | THFFA | Sartomer Co. | Exton, PA |
| N-vinyl caprolactam | NVC | BASF | Ludwigshafen, Germany |
| Isooctyl acrylate | IOA | Sartomer Co. | Exton, PA |
| Tris (2-hydroxyethyl) isocyanurate triacrylate | "SR 368" | Sartomer Co. | Exton, PA |
| | Oligomers | | |
| Aliphatic urethane acrylate | "CN983" | Sartomer Co. | Exton, PA |
| Aliphatic urethane acrylate diluted with 10% EEEA | "Ebecryl 8800" | UCB Chemicals | Smyrna, GA |
| Aliphatic urethane triacrylate diluted with 15% HDDA | "Ebecryl 264" | UCB Chemicals | Smyrna, GA |
| Aliphatic urethane diacrylate diluted with 12% HDDA | "Ebecryl 284" | UCB Chemicals | Smyrna, GA |
| Modified polyester acrylate | "Ebecryl 80" | UCB Chemicals | Smyrna, GA |
| Low viscosity multi-functional acrylated polyester | "Ebecryl 81" | UCB Chemicals | Smyrna, GA |
| Triazine type urethane acrylate oligomer | Oligomer A[1] | — | — |
| TMDI type urethane acrylate oligomer | Oligomer B[2] | — | — |
| | Photoinitiators/Synergists | | |
| Bis(2,4,6-trimethylbenzoyl) phenylphosphine oxide | "Irgacure 819" | Ciba Specialty Chemicals | Tarrytown, NY |
| 2,2-Dimethoxy-1,2-diphenylethan-1-one | "Irgacure 651" | Ciba Specialty Chemicals | Tarrytown, NY |
| 2-Benzyl-2-dimethylamino-1-(4-morpholinophenyl)butan-1-one | "Irgacure 369" | Ciba Specialty Chemicals | Tarrytown, NY |
| Benzophenone | Benzophenone | Sartomer Co | Exton, PA |
| Isopropylthioxanthone | "Speedcure ITX" also called "IPTX" | Aceto Corp. | New Hyde Park, NY |
| Tetraethyleneglycol bis(3-morpholinopropionate) | T-4 Morpholine Adduct[3] | — | — |
| | Stabilizers | | |
| A mixture of bis(1,2,2,6,6-pentamethyl-4-piperidinyl)-sebecate and 1-(Methyl)-8-(1,2,2,6,6-pentamethyl-4-piperidinyl)-sebecate | "Tinuvin 292" | Ciba Specialty Chemicals | Tarrytown, NY |
| 2,2',6,6'-Tetraisopropyldiphenyl carbodiimide | "Stabaxol I" | Rhein Chemie Corp. | Trenton, NJ |
| Thiodiethylene bis[3-(3,5-di-tert-butyl-4-hydroxyphenyl) propionate] | "Irganox 1035" | Ciba Specialty Chemicals | Tarrytown, NY |
| | Flow Agents | | |
| Acrylated silicone | "Tegorad 2500" | Goldschmidt Chemical Corp. | Hopewell, VA |
| Silicone | "SF96-100" | GE Corp. | Waterford, NY |

TABLE B-continued

Ingredients in Ink Compositions Used in the Examples

| Chemical Name/Description | "Trade Designation"/ Abbreviation | Source | Location |
|---|---|---|---|
| | Pigments | | |
| Maroon pigment | C.I. Pigment Red 179 | Bayer Corp. | Pittsburgh, PA |
| Red pigment | C.I. Pigment Red 224 | Bayer Corp. | Pittsburgh, PA |
| Carbon black pigment | "Lampblack LB-1011" | Pfizer Inc. | New York, NY |
| Yellow pigment | "Bayer Yellow Y5688" | Bayer Corp. | Pittsburgh, PA |
| Magenta pigment | "Monastral Red RT-343-D" | Ciba-Geigy Corp. | Tarrytown, NY |
| Green pigment | C.I. Pigment Green 7 | Sun Chemical Corp. | Fort Lee, NJ |
| | Dispersants | | |
| High molecular weight polyurethane | "Efka 4046"[4] | The Lubrizol Corporation | Wickcliff, OH |
| High molecular weight polyurethane | "Solsperse 32000" | Zeneca Inc. | Wilmington, DE |
| | Solvents | | |
| Branched aliphatic ester | "Exxate 600" | ExxonMobile Corp. | Irving, TX |

[1]Oligomer A was prepared as follows: To 260.4 g (1.42 equivalents) of hexamethylene diisocyanate trimer commercially available from Rhodia Corp., Cranberry, NJ under the trade designation "Tolonate HDT-LV" was added 0.2 g dibutyltin dilaurate (Aldrich Chemical Co. ["Aldrich"]) and 0.1 g 2,6-di-*tert*-butyl-4-methylphenol (BHT) (Aldrich), followed by 490 g (1.42 equivalents) of an alcohol-functional polycaprolactone acrylate commercially available from Union Carbide Corp., a subsidiary of Dow under the trade designation "Tone M-100". The temperature was controlled under an atmosphere of dry air to below 85° C. with an ice bath. The reaction mixture was held at 70° C. for 4 hours, at which time Infrared Spectroscopy ("IR") indicated the reaction was complete. The molecular weight was calculated to be 1581 and the Brookfield viscosity was measured at 24,000 centipoise ("cP").

[2]Oligomer B was prepared as follows: To 281.3 g (0.818 equivalents) of Tone M-100 was added 40 mg BHT and 1 drop dibutyltin dilaurate. The reaction mixture was heated under an atmosphere of dry air to 90° C. and 84.2 g (0.8 equivalents) of a mixture of 2,2,4-trimethyl hexamethylene diisocyanate and 2,4,4-trimethylbexamethylene diisocyanate commercially available from Creanova Inc., Somerset, NJ under the trade designation "Vestanat TMDI" was added slowly, controlling the exotherm to under 100° C. with a water bath. The reaction was held at 90° C. for 8 hours, at which time the IR spectrum showed no residual isocyanate. The Brookfield viscosity of the product was determined to be 2500 cP and the calculated molecular weight was 875.

[3]T-4 Morpholine Adduct was prepared as follows: A partial vacuum (approximately 63 cm water vacuum) was pulled on a clean 1-Liter flask having an addition buret and stirring rod attached. The flask was preheated to 37.8° C.. Tetraethylene glycol diacrylate (256 g) was added to the flask with mixing at a moderate rate (approximately 70 rpm). The liquid was allowed to come up to temperature. Morpholine (155 g) was added to the flask at such a rate that the temperature did not exceed 46.1° C.. The temperature control bath was set for 43.3° C. and the flask contents were mixed for 30 minutes. The vacuum on the flask was broken and the fluid reactionproduct (T-4 morpholine) was decanted through a 25 micron filter into a container.

[4]Efka 4046 was supplied as 40 weight percent ("wt %") solids in acetate solvents. Before use, it was dried as follows: precipitated in heptane, the precipitate was rinsed twice in heptane, complete drying was accomplished using evaporation at reduced pressure.

TABLE C

Ink Compositions Used in the Examples (in Wt %)

| Component | Ink #1 | Ink #2 | Ink #3 | Ink #4 | Ink #5 | Ink #6 | Ink #7 |
|---|---|---|---|---|---|---|---|
| Ink #3 | | 55 | | | | | |
| Ink #4 | | 45 | | | | | |
| Benzophenone | 2 | | 2 | 2 | | | 2 |
| IPTX | 1 | | 1 | 1 | 0.5 | 1 | 1 |
| Irgacure 369 | 2 | | 2 | 2 | 0.7 | 2.5 | 2 |
| Irgacure 651 | 2 | | 2 | 2 | 1.5 | 3 | 2 |
| Irgacure 819 | 5 | | 5 | 5 | 3 | 6 | 5 |
| T-4 Morpholine Adduct | 3 | | 3 | 4 | | | 3 |
| Stabaxol I | 0.9 | | 0.9 | 0.9 | | | 0.9 |

TABLE C-continued

| Ink Compositions Used in the Examples (in Wt %) | | | | | | | |
|---|---|---|---|---|---|---|---|
| Component | Ink #1 | Ink #2 | Ink #3 | Ink #4 | Ink #5 | Ink #6 | Ink #7 |
| Irganox 1035 | | | | | | 0.1 | |
| Tinuvin 292 | 2 | | 2 | 2 | 2 | 2 | 2 |
| SF96-100 | | | | | | 0.4 | |
| NVC | 5 | | 5 | 5 | 8 | 10.1 | 5 |
| HDDA | 5 | | 5 | 5 | 9 | 5 | 5 |
| IOA | 24.1 | | 26.1 | 25.1 | | | 25.1 |
| IBOA | 7 | | 6 | 5 | 1.5 | 10.1 | 7 |
| EEEA | 4 | | 7.5 | 6 | 1.5 | 14.1 | 7 |
| THFFA | 4 | | 8 | 3 | 9 | 16.6 | 6 |
| SR 368 | 5 | | | | | | |
| CN 983 | 9 | | | | | | |
| Ebecryl 80 | | | 8 | 5 | | | 9 |
| Ebecryl 81 | 9 | | | | | | |
| Ebecryl 284 | | | 9 | 7 | | | 8 |
| Ebecryl 8800 | | | | | 8 | | |
| Oligomer A | | | | | 16 | | |
| Oligomer B | | | | | | 9 | |
| Exxate 600 | | | | | 10 | | |
| Black dispersion[1] | 10 | | | | | | 10 |
| Yellow dispersion[2] | | | 7.5 | | | | |
| Magenta dispersion[3] | | | | 20 | | 20.1 | |
| Red dispersion[4] | | | | | 16.3 | | |
| Maroon dispersion[5] | | | | | 12.9 | | |

[1]Black dispersion: 25 wt % Lampblack LB-1011 pigment, 5 wt % Solsperse 32000, 70 wt % THFFA.
[2]Yellow dispersion: 33 wt % Bayer Y5688 pigment, 9.9 wt % Solsperse 32000, 57.1 wt % THFFA.
[3]Magenta dispersion: 33.3 wt % Monastral Red RT-343-D pigment, 11.55 wt % Solsperse 32000, 55.45 wt % THFFA.
[4]Red dispersion: 26 wt % C.I. Pigment Red 224, 8.7 wt % Solsperse 32000, 32.65 wt % IBOA, 32.65 wt % EEEA.
[5]Maroon dispersion: 33 wt % C.I. Pigment Maroon 179, 11 wt % Solsperse 32000, 28 wt % IBOA, 28 wt % EEEA.

Inks #1–7 were prepared according to the following general procedure: Each dispersion was first prepared by pre-dissolving the dispersant in the liquid components and then adding the pigment powder. Initial wetting of pigment was accomplished with high shear mixing. Next, the dispersion was subjected to high energy milling in order to reduce the particle size to less than 0.5 microns. The dispersion and all remaining components of the ink composition were then placed together in a jar and thoroughly mixed until all ingredients were completely dissolved.

Additional Inks Used as Obtained from the Source:

Ink #8: Black ink commercially available from Xaar Limited, Cambridge, UK under the trade designation "Xaar Jet UV Black Ink".

Ink #9: Black ink commercially available from Sun Chemicals Corp, Carlstadt, N.J. under the trade designation "Sun UV Flexo Black Ink".

TABLE D

| Ingredients in Primer Compositions Used in the Examples (Not Described in Table C) | | | |
|---|---|---|---|
| Chemical Description | "Trade Designation"/ Abbreviation | Source | Location |
| Vinyl resin and acrylic resin dissolved in solvent | "1910 DR Toner for 3M Scotchcal 1900 Series Inks" | 3M | St. Paul, MN |
| Acrylic resin dissolved in solvent | "880I Toner for 3M Scotchlite 880I Process Color Series Inks" | 3M | St. Paul, MN |
| 2-Butoxyethyl acetate | "3M Scotchcal Thinner CGS50" | 3M | St. Paul, MN |
| Dipropylene glycol monomethyl acetate | DPMA | Dow | Midland, MI |
| Urethane acrylate diluted 15% with HDDA | "CN964B-85" | Sartomer Co. | Exton, PA |
| 1-Hydroxycyclo-hexyl phenyl ketone and benzophenone as a 1:1 ratio by weight | "Irgacure 500" | Ciba Specialty Chemicals | Tarrytown, NY |
| Methyl ethyl ketone | MEK | Worum Chemical Company | St. Paul, MN |
| Methylmethacrylate macromonomer | "AA-6" | Toagosei Co. LTD | Tokyo, Japan |
| Methyl metha-crylate/methyl acrylic acid copolymer in a 90/10 ratio | "Elvacite 1040" | ICI Acrylics Inc. | Wilmington, DE |
| 50 Wt % solids solution of a butyl acrylate/methyl methacrylate copolymer in water | "UCAR 626" | Union Carbide Corp., a subsidiary of Dow | Midland, MI |
| Aqueous dispersion of a sulfo-urethane-silanol polymer in | SUS[1] | — | — |

TABLE D-continued

| Ingredients in Primer Compositions Used in the Examples (Not Described in Table C) | | | |
|---|---|---|---|
| Chemical Description | "Trade Designation"/ Abbreviation | Source | Location |
| water | | | |
| Methyl methacrylate/butyl mthacrylate copolymer | "Paraloid B-66" | Rohm and Haas Company | Philadelphia, PA |

[1]SUS was prepared according to Example 38 of U.S. Pat. No. 5,929,160, employing the following modifications to component ratios and to the hydroxyl equivalent weight of the sulfopolyester polyol: The ratio of reagents was sulfopolyester polyol with a hydroxyl equivalent weight of 333:PCP 0201:ethylene glycol:isophorone diisocyanate (6.0:3.5:7.5:18.7).

Primer Compositions Used in the Examples

Solvent-based Primer Composition A ("Primer A") was a solution of 80% 1910 DR Toner and 20% CGS50.

Solvent-based Primer Composition B ("Primer B") was a solution of 50% 8801 Toner and 50% DPMA.

Solvent-based Primer Composition C ("Primer C") was a solution of 33% 1910 DR Toner and 67% CGS50.

Solvent-based Primer Composition D ("Primer D") was a solution of 25% 8801 Toner and 75% CGS50.

Solvent-based Primer Composition E ("Primer E") was a solution of 16.6% 1910 DR Toner and 83.4% CGS50.

Solvent-based Primer Composition F ("Primer F") was a solution of 50% 8801 Toner and 50% CGS50.

Solvent-based Primer Composition G ("Primer G") was a solution of 15% Paraloid B-66 and 85% CGS50.

Solvent-based reactive Primer Composition H ("Primer H") was a solution of 25% AA-6 and 75% CGS50.

Solvent-based reactive Primer Composition I ("Primer I") was a solution of 25% Elvacite 1040 and 75% MEK.

100% Solids radiation curable Primer Composition J ("Primer J") was a solution of 22.0% CN964B-85, 24.4% THFFA, 24.4% EEEA, 24.4% IBOA, 4.4% Irgacure 500 and 0.44% Tegorad 2500.

Water-based Primer Composition K ("Primer K") was a solution of 90% UCAR 626 and 10% SUS.

Solvent-based Primers A–G were prepared by placing the ingredients in a jar and allowing the mixture to roll on a jar roller overnight to provide a completely homogeneous solution.

Solvent-based reactive Primers H–I were prepared by placing the ingredients in a flask and stirring with a magnetic stir bar until the solution was homogeneous.

100% Solids radiation curable Primer J was prepared in the same manner as Primers H–I.

Water-based Primer K was prepared in the same manner as Primers H–I.

General Procedures and Information Used in the Examples

Prior to jetting, all inks were filtered through a disposable 25 mm diameter syringe filter with 2.7 micron pore size commercially available from Whatman, Inc., Clifton, N.J.

Meyer bar coating of primers was accomplished using a model number KCC303 K-coater, equipped with the indicated US # Meyer rod commercially available from Testing Machines, Inc., Amityville, N.Y.

Xaar Jet XJ128-200 printheads were those commercially available from Xaar Limited, Cambridge, England.

SPECTRA MIATA printhead was that commercially available from Spectra Inc., Hanover, N.J.

Curing of the primer and/or ink was achieved using either the Fusion Systems UV Processor, equipped with the indicated bulb commercially available from Fusion Systems Inc., Gaithersburg, Md. or the RPC UV Processor. equipped with two 30.5 cm medium pressure mercury bulbs, commercially available from RPC industries, Plainfield, Ill.

In examples where indicated, an EFOS ULTRACURE 100SS Plus lamp was also used to achieve immediate partial cure of the ink. With this method, ultraviolet ('UV") light from the EFOS unit lamp was delivered via a gel-filled flexible connection to a location adjacent the printhead. In this configuration, the elapsed time between printing and curing was a fraction of a second. The output of the light was not sufficient for complete cure. Therefore, cure was completed off-line using the Fusion Systems UV Processor.

Test Methods Used in the Examples

Percent adhesion ("Adhesion (%)") was the adhesion of the ink to the substrate or primer measured on the cured articles. The cured articles were conditioned at room temperature at least 24 hours prior to adhesion measurement, which was conducted according to the procedure set out in ASTM D 3359-95A Standard Test Methods for Measuring Adhesion by Tape Test, Method B.

Color Density ("CD") of cured articles was measured using a Gretag SPM-55 densitometer, available from Gretag-MacBeth AG, Regensdorf, Switzerland, No background substraction was used, and the reported values were the average of three measurements. An increase in CD correlated to an increase or improvement in solid ink fill.

Dot Size of an individual cured ink drop was measured using an optical microscope. The reported value was obtained by averaging the diameter of 6 different drops. For the print resolution employed in the examples (approximately 300×300 dpi), the theoretical ink dot diameter should be greater than $2^{1/2}$/dpi (120 microns) but no more than 2/dpi (170 microns). However, in practice we have found that optimum image quality was achieved when this range was increased by 20% to compensate for missing or misfiring nozzles, and non-uniform ink drop size. Therefore, the practical optimum ink dot diameter ranges between 144 microns and 204 microns.

Throughout the examples, the following rating scale was utilized to describe qualitative print quality differences:

Overall Print Quality ("OPQ") Rating Scale:

1−=resolution grainy; poor ink drop spread with coalescence of drops; poor solid ink fill; low gloss.

2−=some loss of resolution; less coalescence of ink drops than 1−; better solid ink fill than 1−.

3=excellent resolution; complete solid ink fill; clean, crisp edges; high gloss.

2+=improved control of ink drop spread, but slight mottled appearance.

1+=ink drop spread too great; solid fill mottled; edges slightly fuzzy.

The preferred OPQ rating in all cases was a "3". Ratings of "1−" and "2−" indicated that the ink flow with the particular combination of ink and primer was not sufficient to generate complete solid fill, with 2− being closer to 3 than 1−. Conversely, "1+" and "2+" ratings indicated that the ink flow was too great, causing degradation to image sharpness.

In the examples below, each substrate was approximately 20 cm×25 cm. For some examples, the unprimed substrate and the substrate coated with primer were individual sheets, each about 20 cm×25 cm in size; for other examples, about one-fourth of a single 20 cm×25 cm sheet was unprimed and the remainder of the sheet was coated with primer. The test pattern printed on each substrate ranged in size from about 15 cm×15 cm to about 17 cm×22 cm.

In the examples below, the letter designation (A, B, etc.) following the example number indicates the primer which was used.

In the examples below, solvent-based primers are used in Examples 1–11 and 16–19. Solvent-based reactive primers are used in Examples 12–15. 100% Solids radiation curable primers are used in Examples 20–23. A water-based primer is used in Examples 24–25.

In general, the examples illustrate that whereas large variability in adhesion, color density and dot size is evident on various unprimed substrates, uniform results are obtained with the use of a primer regardless of the substrate type.

To evaluate resistance to ink and/or primer deterioration as well as delamination of the ink and/or primer from the primer and/or substrate under environmental conditions, all the examples of the invention below, with the exception of Examples 1A, 9B, 13H, 13I, 15H, 15I, 18G and 19G, were subjected to water bath and oven aging. A 2.5 cm square test sample, of which at least a portion was unimaged, was cut from the article with a pair of scissors. The test sample was applied to a 28 cm long×7 cm wide×0.06 cm thick aluminum panel (5052H38; caustic etch and acid desmut treated) commercially available from Q Panel Company, Cleveland, Ohio. For the samples without adhesive (Example Nos. 2A, 7B, 7C, 10D, 10E, 16C and 22J), a single strip of adhesive tape (12.7 mm wide) commercially available from 3M under the trade designation "Scotch Double Stick Tape" was applied along the center of the unimaged surface of the test sample. The test sample was then applied to the panel using hand pressure. All other samples had an adhesive layer and were applied to the panel by first removing the liner and then applying the article to the panel with pressure applied by a hand roller.

For the water bath test, each panel was submerged in a 25° C. water bath for 24 hours. Upon removal from the water bath, each panel was gently wiped dry with a paper towel. After towel wiping, each article was immediately visually inspected and lightly rubbed with a finger. Each article was unchanged from the same article prior to aging; no ink and/or primer deterioration as well as no delamination of the ink and/or primer from the primer and/or substrate was observed. These test results indicate the imaged articles are sufficiently durable for outdoor usage.

For the oven aging test, each panel was placed in a 60° C. oven for 24 hours. Following removal from the oven, each article was immediately visually inspected and lightly rubbed with a finger. Each article was unchanged from the same article prior to aging; no ink and/or primer deterioration as well as no delamination of the ink and/or primer from the primer and/or substrate was observed. These test result indicate that the image article are sufficiently durable for outdoor usage.

Comparative Examples 1–3 and Examples 1–3

Comparative Examples ("Comp. Ex. No.") 1–3 and Examples 1–3 were prepared by jetting Ink #1 onto various substrates. The substrates were either unprimed or coated with Primer A, which had been applied using the KCC K-coater equipped with a US #16 Meyer rod. Nominal primer thickness (i.e., coated wet thickness) was 36.6 microns, with a calculated dry thickness of 9 microns. A test pattern was printed on each substrate using the Spectra Miata printhead equipped with deairation lung at 30° C. on an X-Y stage at 300×300 dpi. Immediately after printing, the printed ink was cured using the Fusion Systems UV processor at 100% power, equipped with an H lamp at a dosage of 200 mJ/cm$^2$ in one pass. The results are set out in Table 1.

The data in Table 1 show that for all examples adhesion was markedly improved compared to the adhesion to the unprimed substrate. Example 1A also showed significant improvement in overall print quality compared to the overall print quality of the imaged unprimed substrate.

TABLE 1

Ink #1 Printed on Substrates Coated with Primer A

| | | Comparative/ Unprimed | | | Primer A | | |
|---|---|---|---|---|---|---|---|
| Ex. No. | Substrate | CD | OPQ | Adhesion (%) | CD | OPQ | Adhesion (%) |
| Comp. 1 & 1A | 180-10 | 1.28 | 1– | 20 | 1.56 | 3 | 100 |
| Comp. 2 & 2A | Panaflex 945 | NM* | NM | 0 | NM | NM | 90 |
| Comp. 3 & 3A | HI | NM | NM | 0 | NM | NM | 100 |

*"NM" = Not Measured.

Comparative Examples 4–7 and Examples 4–7

Comparative Examples 4–7 and Examples 4–7 were prepared by jetting Ink #2 onto various substrates that were unprimed, coated with Primer B, or coated with Primer C. Primer B and Primer C were independently coated onto the substrates using a US #6 Meyer rod and a US #12 Meyer rod; only the results with the US #6 Meyer rod are set out in Table 2. The nominal primer thicknesses using the US #6 Meyer rod and the US #12 Meyer rod were 13.7 microns and 27.4 microns, respectively. The calculated dry thicknesses using the US #6 Meyer rod and US #12 Meyer rod for Primer B were 2.6 microns and 5.0 microns, respectively. The calculated dry thicknesses using the US #6 Meyer rod and US #12 Meyer rod for Primer C were 1.7 microns and 3.5 microns, respectively.

A test pattern was printed on each substrate using the Spectra Miata printhead equipped with deairation lung at 30° C. on an X-Y stage at 300×300 dpi. For the substrates coated using the US #6 Meyer rod and the corresponding comparative unprimed substrates, one pass of the printhead was used. For the substrates coated using the US #12 Meyer rod and the corresponding comparative unprimed substrates, two passes of the printhead were used.

Immediately after printing, the printed ink was cured using the Fusion Systems UV processor at 100% power, equipped with an H bulb at a dosage of 240 mJ/cm$^2$ in one pass. The results using the US #6 Meyer rod are set out in Table 2.

All the samples on which the primer had been coated with the US #12 Meyer rod showed the same trends as those set out in Table 2 (using the US #6 Meyer rod), except that a darker more saturated red ink color was observed and the ink never exceeded the primer's capacity to control the ink flow.

The data in Table 2 show that for all examples, except for the overall print quality of Example 5B, adhesion and overall print quality were either the same as or improved relative to the same properties measured on the unprimed substrates. Additionally, the color density measurement showed improvement in solid ink fill for each primer/ink combination for which it was measured.

TABLE 2

Ink #2 Printed on Substrates Coated with Primer B or Primer C

| | | Comparative/ Unprimed | | | Primer B | | | Primer C | | |
|---|---|---|---|---|---|---|---|---|---|---|
| Ex. No. | Substrate | OPQ | Adhesion (%) | CD | OPQ | Adhesion (%) | CD | OPQ | Adhesion (%) | CD |
| Comp. 4, 4B & 4C | 180-10 | 1– | 100 | 0.91 | 3 | 100 | NM | 3 | 100 | 1.02 |
| Comp. 5, 5B & 5C | HI | 2+ | 60 | 1.16 | 1– | 99 | NM | 3 | 100 | 1.28 |
| Comp. 6, 6B & 6C | 3540C | 1– | 95 | 0.80 | 2– | 95 | 1.02 | 2– | 99 | 1.01 |
| Comp. 7, 7B & 7C | Panaflex 931 | 1– | 95 | 0.86 | 2– | 95 | 1.02 | 1– | 99 | NM |

UV light transmission of polypropylene films was measured. Polypropylene film (25.4 microns thick) was unprimed or independently coated with "Modified Primer B" (Primer B with 100% 8801 Toner [no DPMA]) and "Modified Primer C" (Primer C with 74% 1910 DR Toner and 26% CGS50). The primers were coated onto the film using the KCC K-coater.

Modified Primer B was independently coated onto the polypropylene film with a US #6 Meyer rod, a US #12 Meyer rod and a US #20 Meyer rod, resulting in nominal primer thicknesses of 13.7 microns, 27.4 microns and 45.7 microns with calculated dry thicknesses of 5.0 microns, 10.0 microns and 17.0 microns, respectively.

Modified Primer C was independently coated onto the polypropylene film with a US #5 Meyer rod, a US #10 Meyer rod and a US #16 Meyer rod, resulting in nominal primer thicknesses of 11.4 microns, 22.9 microns and 36.6 microns with calculated dry thicknesses of 3.2 microns, 6.4 microns and 10.2 microns, respectively.

The coated films were allowed to air dry overnight. The UV absorption of the primer-coated polypropylene films in the region below 260 nm, where UV radiation is most harmful to underlying polymeric substrates, was measured using a UV/VIS Spectrometer Lambda 19 commercially available from Perkin Elmer Inc., Boston, Mass.

The transmission of the unprimed UV light transparent polypropylene film was 90%, whereas the transmission of the Modified Primer B- and Modified Primer C-coated polypropylene film was 30% and 20%, respectively. For both Modified Primer B and Modified Primer C, all three primer thicknesses showed the same UV absorption spectrum when the results were normalized. The marked reduction in transmission indicated enhanced absorption of UV radiation below 260 nm by the primer and may reduce the degradation caused by UV radiation to sensitive substrates such as HI and 180-10.

Comparative Examples 8–9 and Examples 8–9

Comparative Examples 8–9 and Examples 8–9 were prepared as described in Comparative Examples 1–3 and Examples 1–3, except that Ink #5 was used. The jetting temperature was elevated to 60° C. in order to reduce the ink viscosity to the jettable range of 18.6 cP at 60° C. and 1000 $s^{-1}$. The viscosity was measured using a Rheometrics SR-200 (Rheometric Scientific, Inc., Piscataway, N.J.) controlled stress rheometer with the cup and bob geometry.

The primers were independently coated onto the substrates using a US #6 Meyer rod and a US #12 Meyer rod; only the results with the US #6 Meyer rod are set out in Table 3. When the primers in Table 3 were coated onto the substrates using a US #12 Meyer rod, the inks were jetted onto them using two passes. In general, the results using the US #12 Meyer rod were more pronounced than those provided in Table 3 (using the US #6 Meyer bar for coating the primer).

The data in Table 3 shows the improvement in adhesion to the primed substrate compared to adhesion to the unprimed substrate, especially for Example 8, which showed an increase in adhesion from 50 to 99–100%. For Example 9C, the overall print quality improved from a 1– for Comp. Ex. 9 to a 2– with improvement in ink flow and solid ink fill.

TABLE 3

Ink #5 Printed on Substrates Coated with Primer B or Primer C

| | | Comparative/ Unprimed | | Primer B | | Primer C | |
|---|---|---|---|---|---|---|---|
| Ex. No. | Substrate | OPQ | Adhesion (%) | OPQ | Adhesion (%) | OPQ | Adhesion (%) |
| Comp. 8, 8B & 8C | HI | 2+ | 50 | 1− | 99 | 2+ | 100 |
| Comp. 9, 9B & 9C | 3540C | 1− | 99 | NM | NM | 2− | 100 |

Comparative Example 10 and Example 10

Comparative Example 10 and Example 10 were prepared by jetting Ink #8 onto substrate 2033. The substrate was unprimed, coated with Primer D, or coated with Primer E. The primed substrates were prepared by hand spraying the primer solution using a hand-held spray bottle onto the non-woven film substrate 2033. After drying, the primed nonwoven construction was weighed and had a coating weight of approximately 0.0039 g/cm$^2$.

A test pattern was printed on each substrate using the XAAR XJ128-200 printhead on an X-Y stage at 317×295 dpi. Immediately after printing, the printed ink was cured using the Fusion Systems UV processor at 100% power, equipped with an H bulb at a total dosage of 480 mJ/cm$^2$ in two passes.

The printed image on unprimed 2033 showed poor resolution with ink wicking along the fibers of the sheet; the text was not readable and the lines were not resolved. On the other hand, the printed image on the substrates coated with either Primer D (Ex. No. 10D) or Primer E (Ex. No. 10E) showed marked improvement in image sharpness, line resolution and text readability.

Comparative Example 11 and Example 11

Comparative Example 11 and Example 11 were prepared by jetting Ink #9 onto substrate 3540C. The substrate was either unprimed or coated with Primer F, which was applied using a US #6 Meyer rod, followed by air drying overnight. A test pattern was printed on each substrate using the XAAR XJ128-200 on an X-Y stage at 317×295 dpi. Immediately after printing, the printed ink was cured using the Fusion Systems UV processor at 100% power, equipped with an H bulb at a total dosage of 480 mJ/cm$^2$ in two passes. The results are set out in Table 4.

The data in Table 4 show improvement in ink adhesion to the primed substrate compared to the ink adhesion to the unprimed substrate. Both color density and dot size of the printed image on 3540C coated with Primer F increased compared to the printed image on unprimed 3540C, evidence of more complete solid ink fill.

TABLE 4

Ink #9 Printed on Substrate 3549C Coated with Primer F

| Ex. No. | Adhesion (%) | Black Color Density | Dot Size (Microns) |
|---|---|---|---|
| Comp. 11 | 90 | 1.59 | 118 |
| 11F | 98 | 1.65 | 183 |

Comparative Examples 12–15 and Examples 12–15

Comparative Examples 12–15 and Examples 12–15 were prepared by jetting Ink #7 onto substrates HI and DG. The substrates were unprimed, coated with Primer H, or coated with Primer I. Primer H and Primer I were independently coated onto the substrates at two film thicknesses, using a KCC K-coater equipped with a US #6 Meyer rod and a US #10 Meyer rod, followed by air drying overnight.

A test pattern was printed on each substrate using the XAAR XJ128-200 on an X-Y stage at 317×295 dpi. Immediately after printing, the printed ink was cured using the Fusion Systems UV processor at 100% power, equipped with an H bulb at a total dosage of 480 mJ/cm$^2$ in two passes. Adhesion was measured and the results are set out in Table 5.

The data in Table 5 show a marked improvement in ink adhesion to the primed substrates compared to the ink adhesion to the unprimed substrate. When assessed visually, the printed image on the primed substrate showed excellent resolution and clean, crisp edges, whereas the printed image on the unprimed substrate had fuzzy edges.

TABLE 5

Ink #7 Printed on Substrates Coated with Primer H or Primer I

| Ex. No. | Substrate | US Meyer Rod (#) | Comparative/ Unprimed Adhesion (%) | Primer H Adhesion (%) | Primer I Adhesion (%) |
|---|---|---|---|---|---|
| Comp. 12, 12H & 12I | HI | 6 | 0 | 85 | 85 |
| Comp. 13, 13H & 13I | HI | 10 | 0 | 80 | 85 |
| Comp. 14, 14H & 14I | DG | 6 | 0 | 85 | 85 |
| Comp. 15, 15H & 15I | DG | 10 | 0 | 80 | 90 |

Comparative Example 16 and Example 16

Comparative Example 16 and Example 16 were prepared by jetting Ink #8 onto substrate SP 700. The substrate was either unprimed or coated with Primer C, which was applied using a US #6 Meyer rod and allowed to air dry overnight. A test pattern was printed on each substrate using the XAAR XJ128-200 on an X-Y stage at 317×295 dpi. Immediately after printing, the printed ink was cured using the Fusion Systems UV processor at 100% power, equipped with an H bulb at a total dosage of 480 mJ/cm$^2$ in two passes. The results are set out in Table 6.

The data in Table 6 show the marked increase in color density and dot size of the printed image on Primer C-coated SP 700 compared to the printed image on unprimed SP 700.

TABLE 6

Ink #8 Printed on Substrate SP 700 Coated with Primer C

| Ex. No. | Black Color Density | Dot Size (Microns) |
|---|---|---|
| Comp. 16 | 0.91 | 102 |
| 16C | 1.76 | 158 |

Comparative Example 17 and Example 17

Comparative Example 17 and Example 17 were prepared by jetting Ink #8 onto substrate 3540C. The substrate was unprimed, coated with Primer C, or coated with Primer F. Primer C and Primer F were independently coated onto substrate 3540C using a US #6 Meyer rod and allowed to air dry overnight. A test pattern was printed on each substrate using the XAAR XJ128-200 on an X-Y stage at 317×295 dpi. Immediately after printing, the printed ink was cured using the Fusion Systems UV processor at 100% power, equipped with an H bulb at a total dosage of 480 mJ/cm$^2$ in two passes. The results are shown in Table 7.

The data in Table 7 show the marked increase in overall print quality, black color density and dot size of the printed image on primer coated 3540C film compared to the printed image on unprimed 3540C. Note that for Ink #7, coating 3540C with primer F resulted in optimum image quality, while coating with primer C caused over compensation in image quality and dot gain.

TABLE 7

Ink #7 Printed on 3540C Film Coated with Primer C or Primer F

| Ex. No. | OPQ | CD | Dot Size (Microns) |
|---|---|---|---|
| Comp. 17 | 1– | 1.78 | 131 |
| 17C | 2+ | 2.13 | 229 |
| 17F | 3 | 2.01 | 203 |

Comparative Examples 18–19 and Examples 18–19

Comparative Examples 18–19 and Examples 18–19 were prepared by jetting Ink #7 onto substrates HI and DG. The substrates were either unprimed or coated with Primer G. Primer G was coated onto the substrates using a US #3 Meyer rod and allowed to air dry overnight. A test pattern was printed on each substrate using the XAAR XJ128-200 on an X-Y stage at 317×295 dpi. Immediately after printing, the printed ink was cured using the RPC processor under the following conditions: Normal/Normal settings, 140 feet/minute, 140–170 mJ/cm$^2$.

The data in Table 7 show that adhesion of the printed image to both unprimed HI (Comp. Ex. No. 18) and unprimed DG (Comp. Ex. No. 19) was 0%, whereas adhesion of the printed image to primed HI (Ex. No. 18G) and primed DG (Ex. No. 19G) was 99% and 98%, respectively. The data in Table 7 also show that black color density was increased and dot size decreased to within the optimum range when a primer was applied to the substrate prior to printing.

TABLE 8

Ink #7 Printed on Substrates Coated with Primer G

| | | Comparative/ Unprimed | | | Primer G | | |
|---|---|---|---|---|---|---|---|
| Ex. No. | Substrate | CD | Dot Size (Microns) | Adhesion (%) | CD | Dot Size (Microns) | Adhesion (%) |
| Comp. 18 & 18G | HI | 1.84 | 221 | 0 | 1.98 | 182 | 99 |
| Comp. 19 & 19G | DG | 1.81 | 204 | 0 | 1.92 | 172 | 98 |

Comparative Examples 20–23 and Examples 20–23

Comparative Examples 20–23 and Examples 20–23 were prepared by jetting Ink #6 onto various substrates. The substrates were either unprimed or coated with Primer J, which was applied using a US #6 Meyer rod. A test pattern was printed on each substrate using the XAAR XJ128-200 on an X-Y stage at 317×295 dpi. For Examples 20J, 21J, 22J and 23J, Ink #6 was printed onto the uncured primed surface and cured in-line (within 1 second of the ink drop delivery to the primed substrate) using the EFOS curing unit. Then the entire printed image was cured using the Fusion Systems UV processor at 100% power, equipped with an H bulb at a total dosage of 720 mJ/cm$^2$ in three passes. The results are set out in Table 9.

The data in the Table 9 show that ink adhesion remained the same as or improved on substrates coated with Primer J compared to the ink adhesion to the unprimed substrates. Dot size was improved on the primed substrates, either by increasing the dot size on the substrates with low dot size or decreasing the dot size on substrates that exhibited too much ink flow. The Primer J-coated substrates exhibited uniform dot size within the target range of 144 microns to 102 microns.

TABLE 9

Ink #6 Printed on Substrates Coated with Primer J

| Ex. No. | Substrate | Adhesion (%) | CD | Dot Size (Microns) |
|---|---|---|---|---|
| Comp. 20 | 510–10 | 0 | 0.94 | 169 |
| 20J | 510–10 | 100 | 0.98 | 142 |
| Comp. 21 | DG | 20 | 1.26 | 168 |
| 21J | DG | 100 | 1.25 | 149 |
| Comp. 22 | Panaflex 930 | 100 | 0.82 | 115 |
| 22J | Panaflex 930 | 100 | 0.90 | 161 |
| Comp. 23 | 160C-30 | 100 | 0.64 | 120 |
| 23J | 160C-30 | 100 | 0.82 | 151 |

Comparative Examples 24–25 and Examples 24–25

Comparative Examples 24–25 and Examples 24–25 were prepared by jetting Ink #7 onto substrates HI and DG. The substrates were either unprimed or coated with Primer K. Primer K was coated onto the substrates using a KCC K-coater equipped with a US #6 Meyer rod and allowed to air dry overnight. A test pattern was printed on each substrate using the XAAR XJ128-200 on an X-Y stage at 317×295 dpi. Immediately after printing, the printed ink was cured using the Fusion Systems UV processor at 100% power, equipped with an H bulb at a total dosage of 480 mJ/cm$^2$ in two passes. The results are set out in Table 10.

The data in Table 10 show the marked increase in adhesion (to 99%) of printed images on substrates HI and DG coated with Primer K compared to 0% adhesion of printed images on the unprimed substrates. When visually assessed, the printed images on the primed substrates showed excellent resolution with clean, sharp edges, whereas the printed image on the unprimed substrate was mottled and had fuzzy edges.

TABLE 10

Ink #7 Printed on Substrates Coated with Primer K

| Ex. No. | Substrate | Adhesion (%) | CD | Dot Size (Microns) |
|---|---|---|---|---|
| Comp. 24 | HI | 0 | 2.02 | 205 |
| 24K | HI | 99 | 1.50 | 142 |
| Comp. 25 | DG | 0 | 2.04 | 213 |
| 25K | DG | 99 | 1.76 | 132 |

What is claimed is:

1. An article comprising:

a) a sheet having a primed surface portion; and b) a radiation cured ink jetted image derived from an ink composition comprising at least 25 weight percent of at least one radiation curable monomer disposed on said primed surface portion;

wherein the article is durable for outdoor usage.

2. The article of claim 1 wherein the sheet comprises a polymeric material.

3. The article of claim 2 wherein the polymeric material is thermoplastic or thermosetting.

4. The article of claim 3 wherein the polymeric sheet material is at least one of an acrylic-containing film, a poly(vinyl chloride)-containing film, a poly(vinyl fluoride)-containing film, a urethane-containing film, a melamine-containing film, a polyvinyl butyral-containing film, a polyolefin-containing film, a polyester-containing film and a polycarbonate-containing film.

5. The article of claim 1 wherein the sheet comprises a retroreflective viewing surface.

6. Tire article of claim 1 wherein the image exhibits an improvement in overall print quality in comparison to the same image ink jetted on the same sheet, said sheet being unprimed.

7. The article of claim 1 wherein the ink jetted image comprises an ink that exhibits at least about 80% adhesion to the primed surface portion according to ASTM D 3359-95A.

8. The article of claim 1 wherein the primed surface portion comprises a primer that exhibits at least about 80% adhesion to the sheet according to ASTM D 3359-95A.

9. The article of claim 1 wherein the image has a black color density of at least about 1.5.

10. The article of claim 1 wherein the image has an ink dot diameter of at least $[(2)^{1/2}]$/dpi wherein dpi in the print resolution is dots per linear inch.

11. The article of claim 1 wherein the primed surface portion comprises at least one film-forming resin comprising an acrylic resin, a polyvinyl resin, a polyester, a polyacrylate, a polyurethane and mixtures thereof.

12. The article of claim 1 wherein the primed surface portion comprises at least 25 percent by weight of an acrylic resin.

13. The article of claim 1 wherein the primed surface portion comprises at least 50 percent by weight of an acrylic resin.

14. The article of claim 1 wherein the primed surface portion comprises at least 10 percent by weight of a polyurethane resin.

15. The article of claim 1 wherein the primed surface portion comprises at least 25 percent by weight of a polyurethane resin.

16. The article of claim 1 wherein the primed surface portion comprises crosslinked po!y(meth)acrylate.

17. The article of claim 1 wherein the primed surface portion comprises at least one colorant.

18. The article of claim 1 wherein the ink comprises crosslinked poly(meth)acrylate.

19. An article comprising:

a) a polymeric substrate having a primed surface portion; and b) a radiation cured ink jetted image derived from an ink composition comprising, at least 25 weight percent of at least one radiation curable monomer disposed on said primed surface portion;

wherein the article is durable for outdoor usage.

20. Signage comprising the article of claim 1.

21. Commercial graphic film comprising the article of claim 1.

22. The article of claim 1 further comprising a protective layer disposed on the image.

23. The article of claim 19 further comprising a protective layer disposed on the image.

* * * * *

UNITED STATES PATENT AND TRADEMARK OFFICE

CERTIFICATE OF CORRECTION

PATENT NO. : 6,720,042 B2
DATED : April 13, 2004
INVENTOR(S) : Ylitalo, Caroline M.

It is certified that error appears in the above-identified patent and that said Letters Patent is hereby corrected as shown below:

Title page,
Item [56], References Cited, OTHER PUBLICATIONS, "Practical Consideration" reference, delete "Pringing" and insert -- Printing --, therefor.

Column 9,
Line 23, delete "8801" and insert -- 880I --, therefor.

Column 12,
Line 49, below "R" insert -- $(NCO)_n$ --, therefor.

Column 18,
Line 3, delete "SB" and insert -- 5B --, therefor.

Column 25,
Line 14, (below Table B), delete "trimethylbexamethylene" and insert -- trimethylhexamethylene --, therefor.

Column 29,
Lines 23, 28 and 32, delete "8801" and insert -- 880I --, therefor.

Column 30,
Line 8, after "Processor" delete "." and insert -- , --, therfor.

Column 33,
Line 39, delete "8801" and insert -- 880I --, therefor.

Column 35,
Line 57, delete "3549C" and insert -- 3540C --, therefor.

Column 39,
Line 39, delete "Tire" and insert -- The --, therefor.

UNITED STATES PATENT AND TRADEMARK OFFICE

CERTIFICATE OF CORRECTION

PATENT NO. : 6,720,042 B2
DATED : April 13, 2004
INVENTOR(S) : Ylitalo, Caroline M.

It is certified that error appears in the above-identified patent and that said Letters Patent is hereby corrected as shown below:

Column 40,
Line 25, delete “po!y” and insert -- poly --, therefor.
Line 36, after “comprising” delete “,”.

Signed and Sealed this

Fourteenth Day of December, 2004

JON W. DUDAS
*Director of the United States Patent and Trademark Office*